US008573581B2

(12) United States Patent
Suzuki et al.

(10) Patent No.: US 8,573,581 B2
(45) Date of Patent: Nov. 5, 2013

(54) SKEW CORRECTION DEVICE, IMAGE FORMING SYSTEM, AND SKEW CORRECTION METHOD

(75) Inventors: Nobuyoshi Suzuki, Tokyo (JP); Kiyoshi Hata, Tokyo (JP); Kei Sasaki, Miyagi (JP); Shingo Matsushita, Tokyo (JP); Makoto Hidaka, Tokyo (JP); Takashi Saito, Kanagawa (JP); Akihiro Musha, Kanagawa (JP); Takamasa Matsumoto, Miyagi (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/537,307

(22) Filed: Jun. 29, 2012

(65) Prior Publication Data

US 2013/0001849 A1 Jan. 3, 2013

(30) Foreign Application Priority Data

Jun. 30, 2011 (JP) ..... 2011-146425

(51) Int. Cl.
*B65H 39/00* (2006.01)

(52) U.S. Cl.
USPC ..... 270/45; 270/32; 270/58.12; 270/58.07; 270/58.27; 270/58.17

(58) Field of Classification Search
USPC ..... 270/32, 45, 58.12, 58.17, 58.27, 58.07; 271/271, 275, 277
See application file for complete search history.

(56) References Cited

U.S. PATENT DOCUMENTS

| | | | | |
|---|---|---|---|---|
| 7,328,893 | B2 * | 2/2008 | Kawatsu et al. | 270/58.09 |
| 7,832,716 | B2 * | 11/2010 | Wakabayashi et al. | 270/37 |
| 7,992,864 | B2 * | 8/2011 | Shirasaki | 271/189 |
| 8,162,306 | B2 * | 4/2012 | Suzuki et al. | 270/58.12 |
| 8,186,663 | B2 | 5/2012 | Suzuki et al. | |
| 2005/0147487 | A1 * | 7/2005 | Wakabayashi et al. | 412/9 |
| 2010/0148417 | A1 | 6/2010 | Suzuki et al. | |
| 2010/0239393 | A1 | 9/2010 | Suzuki et al. | |
| 2010/0303585 | A1 | 12/2010 | Asami et al. | |
| 2010/0310340 | A1 | 12/2010 | Suzuki et al. | |
| 2011/0103863 | A1 | 5/2011 | Asami et al. | |
| 2011/0103921 | A1 | 5/2011 | Suzuki et al. | |

(Continued)

FOREIGN PATENT DOCUMENTS

JP 3472772 9/2003

OTHER PUBLICATIONS

English language abstract for Japanese Patent Publication No. 2003-276359 published Sep. 30, 2003.

*Primary Examiner* — Leslie A Nicholson, III
(74) *Attorney, Agent, or Firm* — Harness, Dickey & Pierce, P.L.C.

(57) ABSTRACT

A skew correction device includes: a conveying path through which a booklet formed by folding a sheet bundle is conveyed in a conveying direction; a positioning unit on which a leading-end portion of the booklet in the conveying direction is to abut, the positioning unit being arranged to be able to protrude into and retreat from the conveying path; an abutting unit that pushes a trailing-end portion of the booklet in the conveying direction, thereby moving the booklet toward the positioning unit and causing the leading-end portion of the booklet to abut on the positioning unit; and a pushing force changing unit that changes a pushing force applied by the abutting unit to the booklet to push the booklet against the positioning unit based on a pushing amount of the abutting unit to the booklet.

10 Claims, 14 Drawing Sheets

(56) References Cited * cited by examiner

U.S. PATENT DOCUMENTS

| | | | | |
|---|---|---|---|---|
| 2011/0140335 | A1* | 6/2011 | Abe | 270/4 |
| 2011/0229287 | A1 | 9/2011 | Suzuki | |
| 2012/0087765 | A1 | 4/2012 | Suzuki | |

SKEW CORRECTION DEVICE, IMAGE FORMING SYSTEM, AND SKEW CORRECTION METHOD

CROSS-REFERENCE TO RELATED APPLICATIONS

The present application claims priority to and incorporates by reference the entire contents of Japanese Patent Application No. 2011-146425 filed in Japan on Jun. 30, 2011.

BACKGROUND OF THE INVENTION

1. Field of the Invention

The present invention relates to skew correction devices, image forming systems, and skew correction methods. In particular, the present invention relates to a skew correction device that performs skew correction on a booklet produced by folding sheets of a recording medium such as ordinary paper, recording paper, or transfer paper (hereinafter, abbreviated to "sheets"), an image forming system including the skew correction device, and a skew correction method to be performed by the skew correction device.

2. Description of the Related Art

There are widely known sheet processing apparatuses arranged downstream of an image forming apparatus body to perform postprocessing, such as stapling, on recording sheets or the like output from the image forming apparatus. Such sheet processing apparatuses have come to incorporate multiple functions recently, and sheet processing apparatuses capable of not only side stitching as in conventional apparatus but also saddle stitching and making booklets have become common. Some type of sheet processing apparatuses, which perform saddle stitching and booklet making, further cut an edge(s) of a stapled booklet using a cutting apparatus to increase quality of outputs.

In such a cutting apparatus, a booklet to be cut is typically conveyed by a conveying unit such as a belt and positioned by being abutted against a positioning stopper set to adapt to a size of the booklet, a cut amount, and/or the like. Thereafter, a cutting unit cuts an edge of the booklet that is pressed and fixed by a pressing unit. Thereby, an edge of the stapled booklet is evenly trimmed.

However, in the conventional cutting apparatus, the conveying unit such as a belt rotates in a state where the booklet is in contact with the positioning stopper. This can cause a surface sheet of the booklet to be swollen out. When such a booklet is cut as-is, the side of the cut booklet becomes uneven. Furthermore, when the pressing section presses the booklet in a manner to flatten the swelling of the booklet, a front side or a back side of the booklet can be warped while the booklet is pressed by the pressing unit, and possibly further resulting in that the booklet is moved forward or backward and pressed in a misaligned state. Accordingly, cutting the booklet in such a pressed state can undesirably make the edge of the cut booklet uneven.

Examples of known techniques for preventing such an uneven edge include a technique disclosed in Japanese Patent No. 3472772. According to this technique, an apparatus conveys a booklet using an endless belt such that a spine of the booklet is a leading end, includes, at a downstream part, a stopper plate on which the spine of the booklet is to abut and an aligning reciprocating piece for back-jogging, and aligns the booklet by lightly pressing a fore edge of the booklet toward a leading end of the booklet. It is argued in Japanese Patent No. 3472772 that the apparatus is highly productive because the apparatus configured as described above can process and convey booklets downward one after another.

According to the technique disclosed in Japanese Patent No. 3472772, the apparatus includes the aligning reciprocating piece for back-jogging that aligns and positions a booklet by jogging a fore edge of the booklet and is configured to align the booklet by lightly pressing the fore edge of the booklet toward the leading end of the booklet. However, a saddle-stitched booklet can generally have an error in length, which may be caused from an error in length of not-yet-center-folded sheets, a center-folding error resulting from deviation in folding position, or an error that a booklet becomes practically shorter when the booklet is not folded completely flat and swollen out. When a booklet has a large error in length, it is difficult to lightly press a fore edge of the booklet with the aligning reciprocating piece for back-jogging-alignment only by position control.

Under the circumstance, a spring or the like can be provided on a jogger to perform alignment or skew correction with a constant pressure when sheets to be aligned have wide variation in sheet size. It is easy to lightly press a fore edge of a booklet using this approach.

However, an appropriate pressure to be applied to a fore edge for alignment varies depending on paper type, paper thickness, number of sheets to be stapled, and a folding height. For instance, when a pressing spring force is insufficient, the spine of the booklet fails to abut on a stopper plate, resulting in misalignment. In contrast, when the pressing spring force is excessively large, the spring shows no resiliency after the booklet has abutted, causing buckling of the booklet leading to damage such as bent and/or scratch. Accordingly, booklets to which alignment or skew correction with certain pressure is applicable are limited. Meanwhile, "abutting" in this document means that something comes into contact with an object and this abutted (contact) condition is maintained. "Pressing" means generating a pressure by pressing. A "pressing force" is a pressure generated by pressing, or, in other word, a force exerted to press something. "At application of pressure" refers to time when an operation of pressing something is performed, or, in other words, when something is pressed.

There is a need to make it possible to perform skew correction on a booklet conveyed to a skew correction device reliably without causing a damage such as misalignment, crease, bent, and/or scratch

SUMMARY OF THE INVENTION

It is an object of the present invention to at least partially solve the problems in the conventional technology.

A skew correction device includes: a conveying path through which a booklet formed by folding a sheet bundle is conveyed in a conveying direction; a positioning unit on which a leading-end portion of the booklet in the conveying direction is to abut, the positioning unit being arranged to be able to protrude into and retreat from the conveying path; an abutting unit that pushes a trailing-end portion of the booklet in the conveying direction, thereby moving the booklet toward the positioning unit and causing the leading-end portion of the booklet to abut on the positioning unit; and a pushing force changing unit that changes a pushing force applied by the abutting unit to the booklet to push the booklet against the positioning unit based on a pushing amount of the abutting unit to the booklet.

An image forming system includes a skew correction device. The skew correction device includes: a conveying path through which a booklet formed by folding a sheet bundle is conveyed in a conveying direction; a positioning unit on which a leading-end portion of the booklet in the conveying direction is to abut, the positioning unit being arranged to be able to protrude into and retreat from the conveying path; an abutting unit that pushes a trailing-end portion of the booklet in the conveying direction, thereby moving the booklet toward the positioning unit and causing the leading-end portion of the booklet to abut on the positioning unit; and a pushing force changing unit that changes a pushing force applied by the abutting unit to the booklet to push the booklet against the positioning unit based on a pushing amount of the abutting unit to the booklet.

A skew correction method includes: conveying a booklet formed by folding a sheet bundle along a conveying path; causing a leading-end portion of the booklet in the conveying direction to abut on a positioning unit arranged to be able to protrude into and retreat from the conveying path; performing skew correction on the booklet by pushing a trailing-end portion of the booklet in the conveying direction, which has abutted on the positioning unit, against the positioning unit; and changing a pushing force, with which the booklet is to be pushed by the abutting unit, based on a pushing amount of the abutting unit to the booklet by setting the pushing amount based on information relating to the pushing amount.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
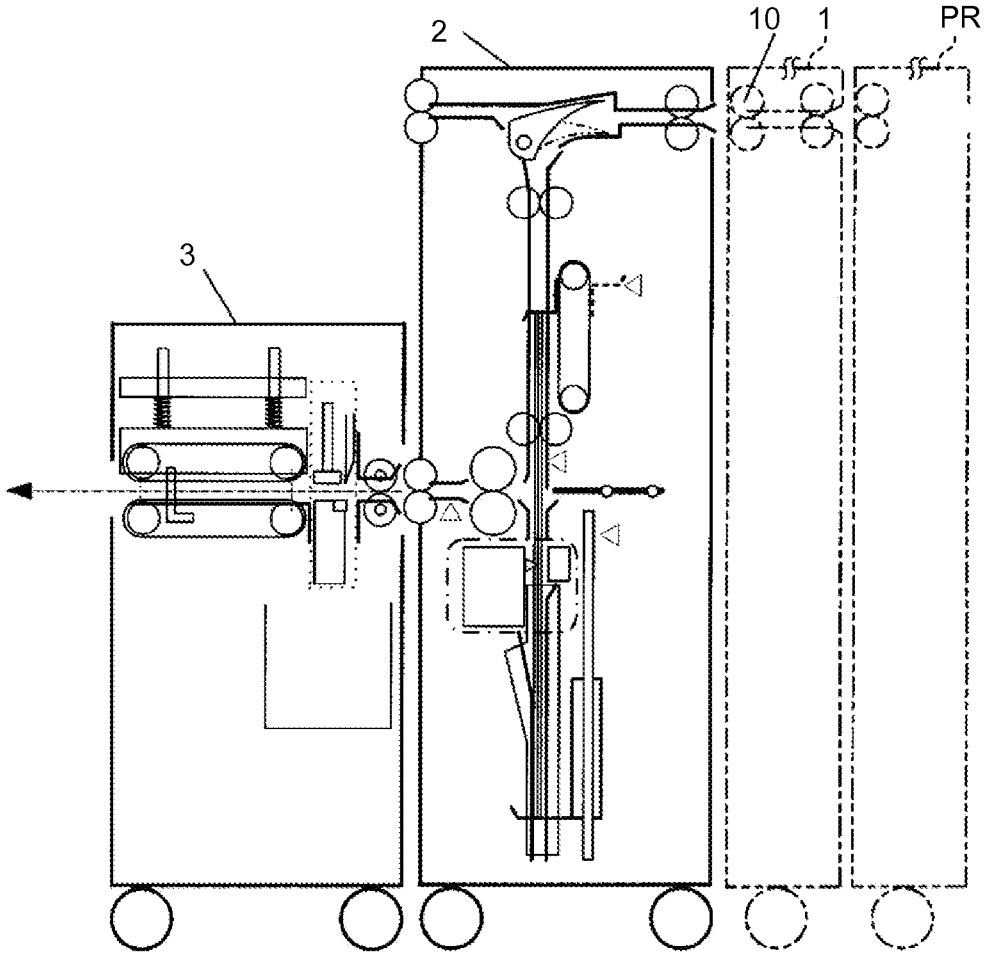
FIG. 1 is a diagram illustrating a system configuration of an image forming system including an image forming apparatus and a plurality of sheet processing apparatuses according to an embodiment of the present invention.

An aspect of the present invention has a feature that pressing springs for pressing a trailing-end jogger in multiple stages are provided and multiple levels of elastic force can be applied using the pressing springs in a stepwise manner depending on amount of pushing the trailing-end jogger toward a booklet, and that a pressing force by the trailing-end jogger can be controlled by changing the amount of pushing toward the booklet depending on booklet information.

Embodiments of the present invention are described below with reference to the accompanying drawings. Equivalent constituents are denoted by the same reference numeral or symbol in the description below, and repeated descriptions are omitted as appropriate.

FIG. 1 is a diagram illustrating a system configuration of an image forming system that includes an image forming apparatus and a plurality of sheet processing apparatuses according to an embodiment of the present invention. In this embodiment, first to third sheet postprocessing apparatuses 1, 2, and 3 are connected to and arranged downstream of an image forming apparatus PR in this order.

The first sheet postprocessing apparatus 1 is a sheet postprocessing apparatus that includes a stacking section and has a sheet bundle producing function. The stacking section receives sheets from the image forming apparatus PR one sheet by one sheet, and stacks and aligns the sheets to produce a sheet bundle. The first sheet postprocessing apparatus 1 discharges the sheet bundle using sheet bundle discharging rollers 10 to the downstream second sheet postprocessing apparatus 2. The second sheet postprocessing apparatus 2 is a saddle-stitch booklet-making apparatus that receives the sheet bundle conveyed to the apparatus 2 and performs center folding and saddle stitching to the sheet bundle. Hereinafter, the second sheet postprocessing apparatus may be also referred to as the saddle-stitch booklet-making apparatus.

The saddle-stitch booklet-making apparatus 2 discharges the thus-made booklet to the third sheet processing apparatus 3. The third sheet processing apparatus 3 is a cutting apparatus that cuts a fore edge of the booklet conveyed into the cutting apparatus. The third sheet postprocessing apparatus hereinafter may be also referred to as the cutting apparatus. The booklet cut by the cutting apparatus 3 is discharged as-is to the outside of the cutting apparatus 3 and loaded on a discharge tray (not shown). Alternatively, when another sheet processing apparatus is connected downstream to the cutting apparatus 3, the booklet is discharged as-is into this sheet processing apparatus. The image forming apparatus PR forms a visible image on a sheet-like recording medium based on image data that is input to the image forming apparatus PR or obtained by scanning. The image forming apparatus PR corresponds to, for instance, a copying machine, a printing machine, a facsimile machine, or a multifunction periphery having at least two functions of these machines.

Figure 2:
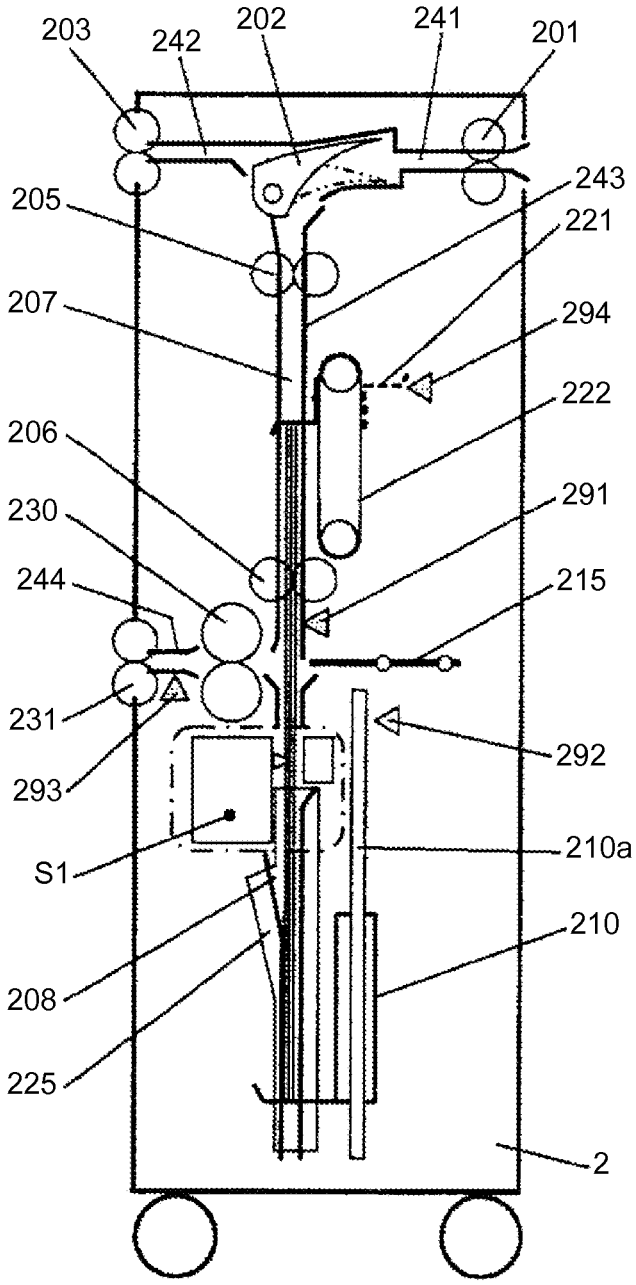
FIG. 2 is a diagram illustrating in detail the configuration of a second sheet postprocessing apparatus (saddle-stitch booklet-making apparatus), which is one of the sheet processing apparatuses illustrated in FIG. 1.

FIG. 2 is a diagram illustrating in detail the configuration of the saddle-stitch booklet-making apparatus 2 illustrated in FIG. 1. In FIG. 2, the saddle-stitch booklet-making apparatus 2 includes an entrance conveying path 241, a passing-though conveying path 242, and a center-folding conveying path 243. Entrance rollers 201 are arranged most upstream of the entrance conveying path 241 in a sheet conveying direction to receive the aligned sheet bundle from the sheet bundle discharging rollers 10 of the first sheet processing apparatus 1. In the description below, upstream in the sheet conveying direction is abbreviated as upstream, and downstream in the sheet conveying direction is abbreviated as downstream.

A branch claw 202 is arranged downstream of the entrance rollers 201 in the entrance conveying path 241. The branch claw 202 is horizontally oriented in FIG. 2. The branch claw 202 causes the sheet bundle to be conveyed to either the passing-though conveying path 242 or the center-folding conveying path 243. The passing-though conveying path 242 is a conveying path that extends horizontally from the entrance conveying path 241 to guide a sheet bundle to either the downstream processing apparatus (not shown) or the discharge tray. The sheet bundle is discharged downstream by upper discharging rollers 203. The center-folding conveying path 243 is a conveying path that extends vertically downward from the branch claw 202 to perform saddle stitching and center folding on a sheet bundle.

The center-folding conveying path 243 includes an upper bundle-conveying guide plate 207 that guides a sheet bundle at a position above a folding plate 215 for use in center folding and a lower bundle-conveying guide plate 208 that guides the sheet bundle at a position below the folding plate 215. Arranged on the bundle-conveying guide plate 207 are upper bundle-conveying rollers 205, a trailing-end tapping claw 221, and lower bundle-conveying rollers 206 in this order from a higher portion to a lower portion. The trailing-end tapping claw 221 stands upright from a trailing-end-tapping-claw driving belt 222 to be driven by a driving motor (not shown). The trailing-end tapping claw 221 is moved by a reciprocating rotary motion of the driving belt 222 to tap (press) a trailing end of the sheet bundle toward a movable fence 210, which will be described later, thereby aligning the sheet bundle. The trailing-end tapping claw 221 retreats from the center-folding conveying path 243 at the upper bundle-conveying guide plate 207 (to a position indicated by a dashed line in FIG. 2) when a sheet bundle is conveyed into the apparatus or when a sheet bundle is elevated to perform center folding.

Reference numeral 294 denotes a trailing-end-tapping-claw HP sensor that detects a home position of the trailing-end tapping claw 221, home position being a position which is indicated by the dashed lines in FIG. 2 and to which the trailing-end tapping claw 221 retreats from the center-folding conveying path 243. The trailing-end tapping claw 221 is controlled with reference to this home position.

Arranged on the lower bundle-conveying guide plate 208 are a saddle-stitch stapler S1, a pair of saddle-stitch jogger fences 225, and a movable fence 210 in this order from highest to lowest. The lower bundle-conveying guide plate 208 is a guide plate that receives the sheet bundle conveyed along the upper bundle-conveying guide plate 207. The pair of saddle-stitch jogger fences 225 is arranged in a width direction of the lower stack-conveying guide plate 208. The movable fence 210 on which the leading end of the sheet bundle is to abut (or to be supported) is arranged at a lower portion of the lower bundle-conveying guide plate 208 and is vertically movable.

The saddle-stitch stapler S1 is a stapler that stitches a sheet bundle at its center portion. The movable fence 210 moves upward and downward in a state of supporting the leading end of the sheet bundle and positions the sheet bundle at a location where the center of the sheet bundle faces the saddle-stitch stapler S1. At this location, the sheet bundle is stapled, i.e., saddle stitched. The movable fence 210 is supported by a movable-fence driving mechanism 210*a* and movable from a position at a movable-fence HP sensor 292, which is in an upper portion of the movable fence 210 in FIG. 2, to a lowermost position. A movable range of the movable fence on which the leading end of the sheet bundle is to abut provides a stroke that allows processing of sheet bundles of various sizes from a maximum size to a minimum size of the sheet bundle that can be processed by the saddle-stitch booklet-making apparatus 2. A rack-and-pinion mechanism can be used as the movable-fence driving mechanism 210*a*, for instance.

The folding plate 215, a pair of folding rollers 230, a discharging conveying path 244, and lower discharging rollers 231 are provided between the upper bundle-conveying guide plate 207 and the lower bundle-conveying guide plate 208, i.e., at a substantially center portion of the center-folding conveying path 243. The folding plate 215 is capable of reciprocating in the horizontal direction in FIG. 2. A nip between the pair of folding rollers 230 is at a position toward which the folding plate 215 moves during a folding operation. The discharging conveying path 244 is arranged on a line that extends from the nip in a direction in which the folding plate 215 moves. The lower discharging rollers 231 are arranged most downstream of the discharging conveying path 244 to discharge folded sheet bundle downstream.

A sheet bundle detection sensor 291 is arranged at a lower end portion of the upper bundle-conveying guide plate 207 to detect the leading end of the sheet bundle conveyed into the center-folding conveying path 243 and passing through the center-folding position. A crease passage sensor 293 is arranged on the discharging conveying path 244 to detect the leading end of the center-folded sheet bundle and recognize passage of the sheet bundle.

The saddle-stitch booklet-making apparatus 2 which is configured as illustrated in FIG. 2 performs saddle stitching and center folding operations roughly as illustrated in explanatory diagrams of the operations depicted in FIGS. 3 to 7. More specifically, when saddle stitching and center folding are selected from an operation panel PN (see FIG. 15) of the image forming apparatus PR, a sheet bundle for which saddle stitching and center folding are selected is guided to the center-folding conveying path 243 because of counterclockwise biased motion of the branch claw 202. The branch claw 202 is driven by a solenoid. The branch claw 202 may alternatively be motor-driven.

Figure 3:
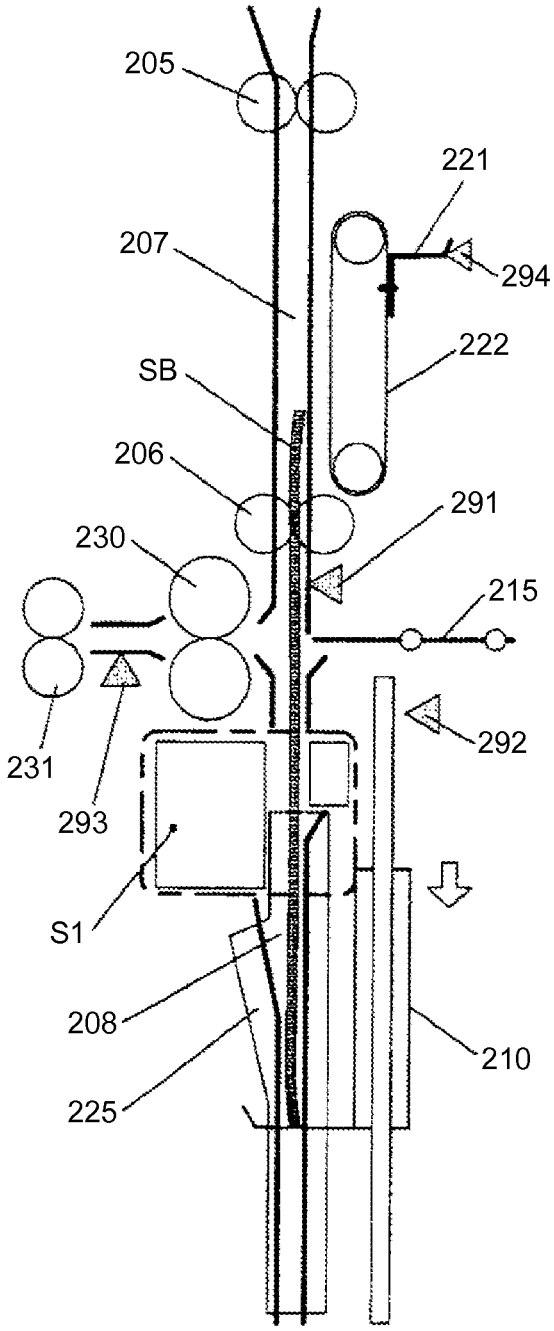
FIG. 3 is an explanatory diagram of operations to be performed by the saddle-stitch booklet-making apparatus, illustrating a state where a sheet bundle is conveyed into the apparatus.

A sheet bundle SB conveyed into the center-folding conveying path 243 is downwardly conveyed along the center-folding conveying path 243 by the entrance rollers 201 and the upper bundle-conveying rollers 205. After passage of the sheet bundle SB is detected by the sheet bundle detection sensor 291, the sheet bundle SB is conveyed by the lower bundle-conveying rollers 206 to a position where a leading end of the sheet bundle SB abuts on the movable fence 210 as illustrated in FIG. 3. The movable fence 210 is on standby for this abutting at a stop position that varies depending on sheet size information fed from the image forming apparatus PR, in this example, depending on information about the size of the sheet bundle SB in the conveying direction. At this time, in FIG. 3, the lower bundle-conveying rollers 206 hold the sheet bundle SB between its nip, and the trailing-end tapping claw 221 is on standby at its home position.

When, from this state, a nip pressure between the lower bundle-conveying rollers 206 is released (in a direction indicated by arrow a), the leading end of the sheet bundle abuts on the movable fence 210, and the sheet bundle is stacked on the movable fence 210 with its trailing end free. Then, the trailing-end tapping claw 221 is driven to tap the trailing end of the sheet bundle SB, thereby performing final alignment in the conveying direction (in a direction indicated by arrow c).

Subsequently, the saddle-stitch jogger fences 225 perform alignment in the width direction (a direction perpendicular to the sheet conveying direction), while the movable fence 210 and the trailing-end tapping claw 221 perform alignment in the conveying direction. Thus, alignment of the sheet bundle SB in the width direction and the conveying direction are completed. Amounts by which the trailing-end tapping claw 221 and the saddle-stitch jogger fences 225 is pushed for this alignment are adjusted to optimum values depending on information about a size of the sheet, information about the number of sheets in the sheet bundle, and/or information about the thickness of the sheet bundle.

When the sheet bundle is thick, space in the conveying path is lessened, and therefore it is often the case that a single aligning operation is insufficient to align the sheet bundle. Accordingly, in such a case, the number of times the aligning operation is performed is increased. More favorable alignment can be achieved by increasing the number of the aligning operation. Furthermore, as the number of sheets to be overlaid on one another in an upstream stacking process increases, a period of time required for the stacking becomes longer, making a time interval between receipt of sheet bundles SB longer. Accordingly, even when the number of times the aligning operation is performed is increased, there is no loss of time for the system, and a favorably aligned state can be achieved efficiently. Therefore, the number of times the aligning operation is performed may also be controlled depending on processing time of the upstream process.

The standby position of the movable fence 210 is generally set to a position where a saddle-stitch position of the sheet bundle SB faces a stapling position of the saddle-stitch stapler S1. This is because performing alignment at this position makes it possible to staple the sheet bundle SB while leaving the sheet bundle SB lying at a position where the sheet bundle SB is stacked without moving the movable fence 210 to the saddle-stitch position of the sheet bundle. At this standby position, a stitcher of the saddle-stitch stapler S1 is moved to the center portion of the sheet bundle SB in a direction indicated by arrow b to perform stapling between the stitcher and a clincher. The sheet bundle SB is thus saddle stitched.

The movable fence 210 is positioned by pulse control from the movable-fence HP sensor 292. The trailing-end tapping claw 221 is positioned by pulse control from the trailing-end-tapping-claw HP sensor 294. A central processing unit (CPU) 251 of a control circuit 250 (see FIG. 15) of the sheet post-processing apparatus 2 executes positioning control of the movable fence 210 and the trailing-end tapping claw 221.

Figure 4:
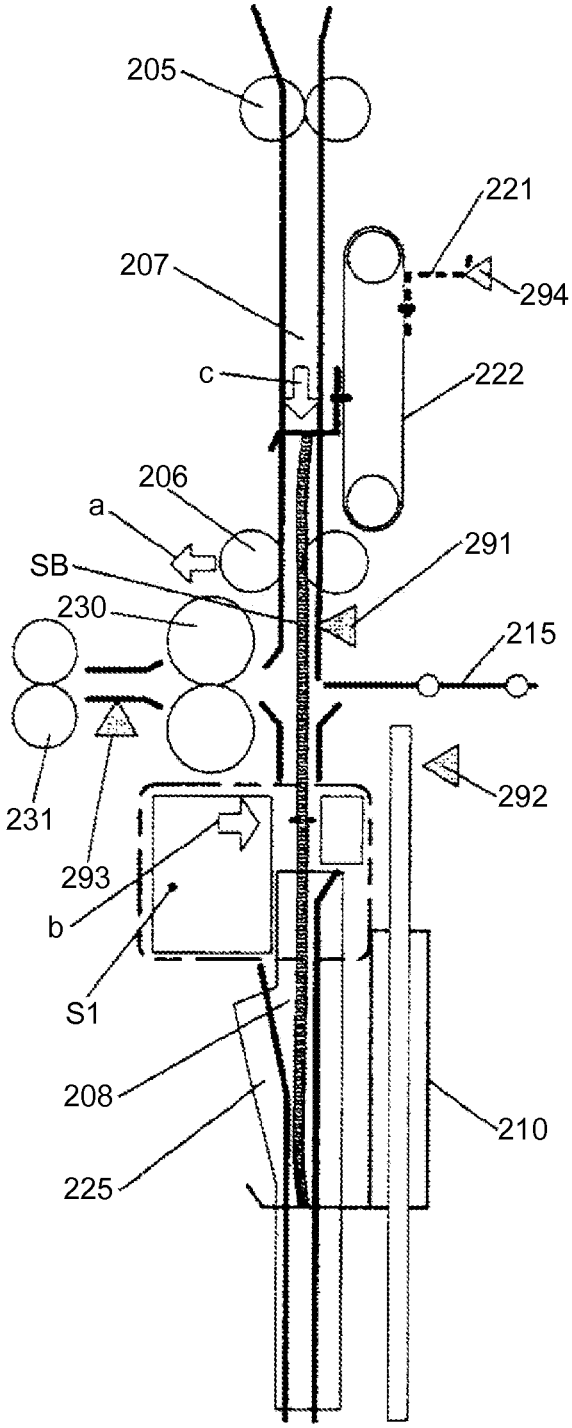
FIG. 4 is an explanatory diagram of the operations to be performed by the saddle-stitch booklet-making apparatus, illustrating a state where the apparatus is saddle stitching the sheet bundle.
Figure 5:
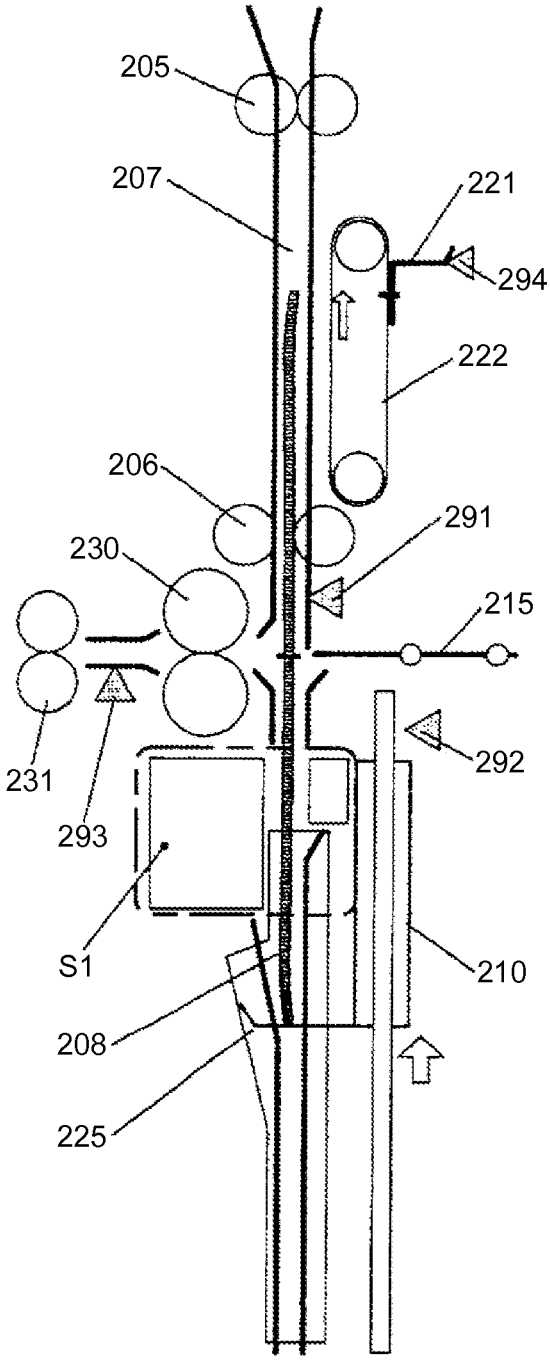
FIG. 5 is an explanatory diagram of the operations to be performed by the saddle-stitch booklet-making apparatus, illustrating a state where the apparatus has moved the sheet bundle to a center-folding position.

As illustrated in FIG. 5, the sheet bundle SB saddle stitched in the state illustrated in FIG. 4 is transported to the position where the saddle-stitch position (the center of the sheet bundle SB in the conveying direction) faces the folding plate 215 as the movable fence 210 moves upward in a state where the pressure applied to the sheet bundle SB from the lower bundle-conveying rollers 206 is released. This position is also controlled with reference to a position detected by the movable-fence HP sensor 292.

Figure 6:
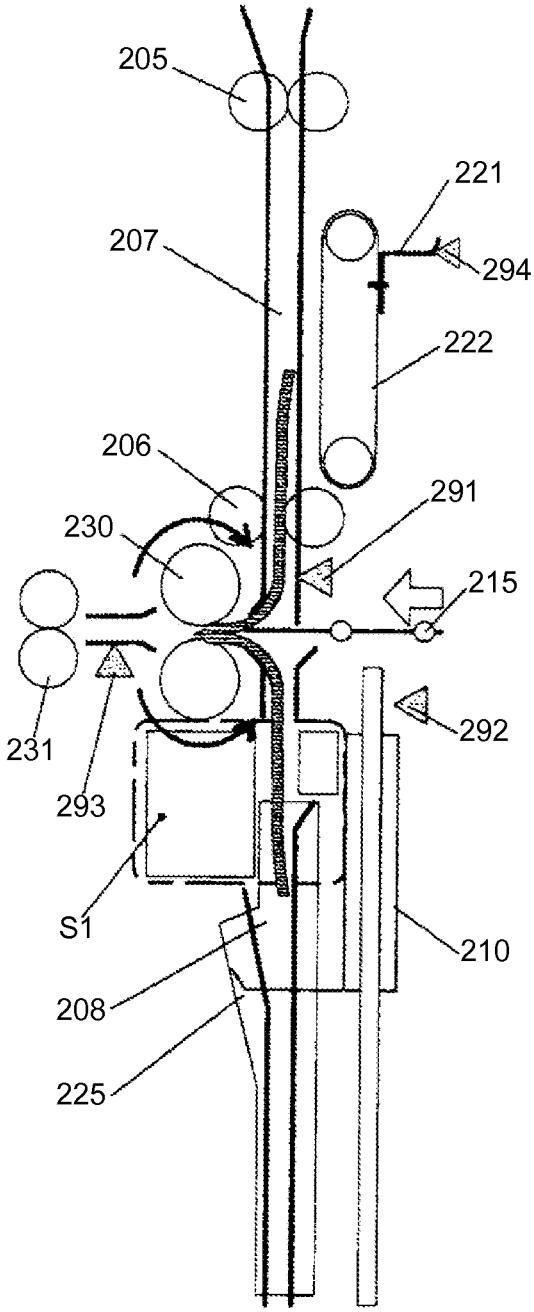
FIG. 6 is an explanatory diagram of the operations to be performed by the saddle-stitch booklet-making apparatus, illustrating a state where the apparatus is center-folding the sheet bundle.

When the sheet bundle SB reaches a position depicted in FIG. 5, the folding plate 215 moves toward the nip between the pair of folding rollers 230 as illustrated in FIG. 6. The folding plate 215 abuts on the sheet bundle SB near a needle portion, at which the sheet bundle SB is stapled, substantially perpendicularly to the sheet bundle SB and pushes the sheet bundle SB toward the nip. The sheet bundle SB is pushed by the folding plate 215 to the nip between the pair of folding rollers 230, rotation of which has started in advance, and pushed into the nip. The pair of folding rollers 230 presses and conveys the sheet bundle SB pushed into the nip. This pressing conveying operation forms a crease in the center of the sheet bundle SB. Thus, a booklet BT subjected to simple bookbinding is made. FIG. 6 illustrates a state where a leading end of a folded portion of the sheet bundle SB is held and pressed in the nip between the pair of folding rollers 230.

Figure 7:
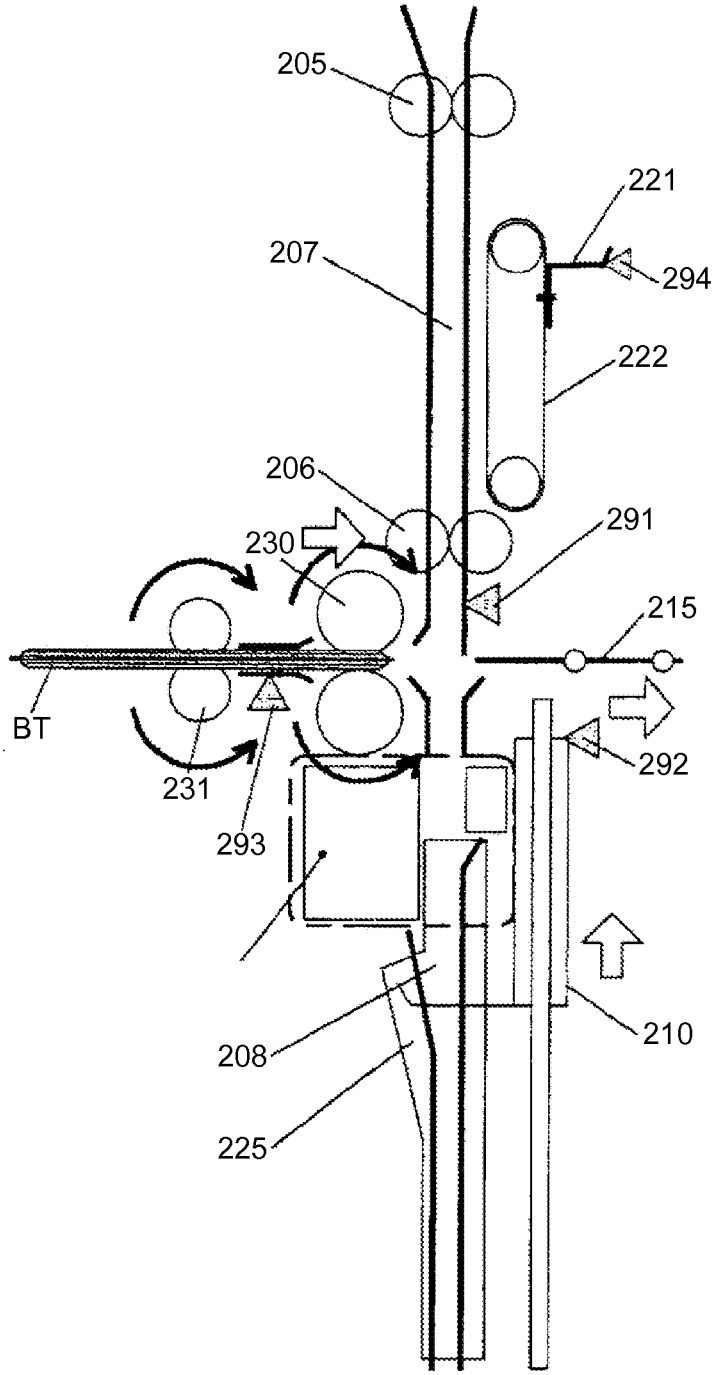
FIG. 7 is an explanatory diagram of the operations to be performed by the saddle-stitch booklet-making apparatus, illustrating a state where the apparatus is discharging the center-folded sheet bundle.

The sheet bundle SB that is folded at its center portion in a state of FIG. 6 is conveyed as the booklet BT by the pair of folding rollers 230 as illustrated in FIG. 7. The booklet BT is then held between the lower discharging rollers 231 and discharged downstream. When a trailing end of the booklet BT is detected by the crease passage sensor 293 at this time, the folding plate 215 and the movable fence 210 are returned to their home positions, and the lower bundle-conveying rollers 206 are returned to a pressing state as preparation for receipt of a next sheet bundle SB. The movable fence 210 may be configured to return to and be on standby at the position illustrated in FIG. 3 when size of sheet and number of sheets in the next job is the same as those in the current job. These control operations are also executed by the CPU 251 of the control circuit 250.

Figure 8:
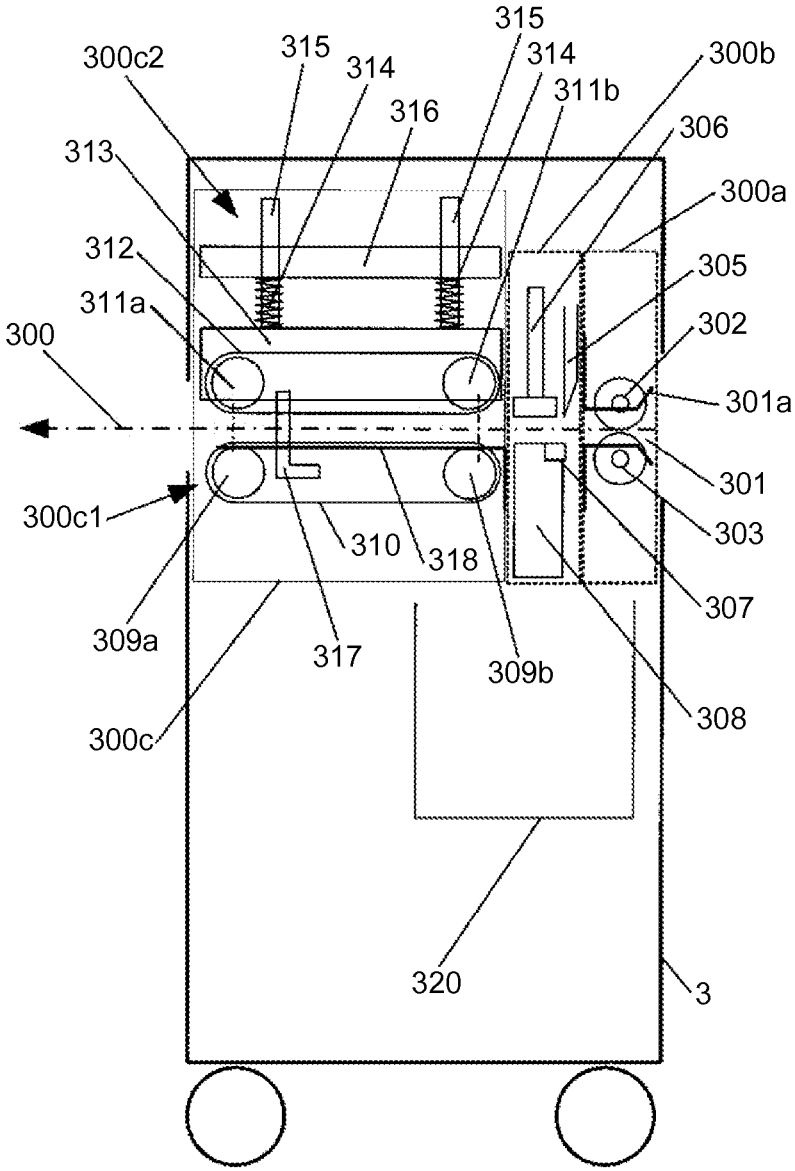
FIG. 8 is a diagram illustrating in detail the configuration of a third sheet processing apparatus (cutting apparatus), which is one of the sheet processing apparatuses illustrated in FIG. 1.

FIG. 8 is a diagram illustrating in detail the configuration of the cutting apparatus 3.

In FIG. 8, the cutting apparatus 3 includes a conveying section 300*a*, a cutting section 300*b*, and an aligning section 300*c* in this order from upstream to downstream along a conveying path 300 (an arrow in the conveying path 300 indicates a conveyance center) for booklets.

The conveying section 300*a* serves as an entrance of the cutting apparatus 3 and includes entrance guide plates 301*a*, a pair of conveying rollers 302 and 303 arranged one above another, and a trailing-end jogger 319. The trailing-end jogger 319 performs alignment in the conveying direction (at a fore edge) of the booklet BT (see FIG. 11). The conveying section 300*a* receives the booklet BT, which is center-folded and saddle-stitched, from the lower discharging rollers 231 of the saddle-stitch booklet-making apparatus 2 by the entrance guide plates 301*a* of a booklet receiving port 301. It is possible to use a pair of conveying belts that are arranged one above another to hold the booklet BT therebetween at a predetermined pressure and convey the booklet BT in lieu of the pair of conveying rollers 302 and 303.

The cutting section 300*b* includes cutting blades and a pressing section arranged with the conveying path 300 therebetween. The cutting blades includes an upper cutting blade 305 and a lower cutting blade 307 that are paired and arranged above and below the conveying path 300 to face each other. The upper cutting blade 305 is movable, while the lower cutting blade 307 is fixed. The movable upper cutting blade 305 descends to the booklet BT positioned on the fixed lower cutting blade 307, thereby cutting the fore edge of the booklet BT therebetween. A waste bin 320 that receives waste pieces from the cut booklet is arranged below the cutting section 300*b*.

The pressing section includes a pressing member 306 that is movable and a base 308 that is fixed. The pressing member 306 and the base 308 are arranged above and below the conveying path 300, respectively. The lower cutting blade 307 is fixed to an edge portion of the base 308 located most upstream in the booklet conveying direction. A position where the lower cutting blade 307 is fixed is set to a position that allows cutting to be performed between a cutting edge of the upper cutting blade 305 and a cutting edge of the lower cutting blade 307. The upper cutting blade 305 is moved downward by a driving mechanism (not shown) to a position beyond the lower cutting blade 307 and moved by the same upward to a position where the upper cutting blade 305 does not interfere with the booklet BT conveyed into the cutting section 300*b*. This upper standby position is an initial position of the upper cutting blade 305.

The pressing member 306 located above the base 308 is moved by a driving mechanism (not shown) upward and downward. The pressing member 306 has a function of pressing the booklet BT near the cutting blade 305 toward the base 308 when the upper cutting blade 305 is lowered to cut the booklet BT. Each of the upper cutting blade 305 and the pressing member 306 is driven by the driving mechanism (not shown) that uses a motor and a reduction gear coupled to the motor. Alternatively, each of the upper cutting blade 305 and the pressing member 306 may be configured to be moved upward and downward hydraulically rather than by the motor and the reduction gear.

The aligning section 300*c* includes a lower unit 300*c*1 positioned below the conveying path 300 and an upper unit 300*c*2 positioned above the conveying path 300. The lower unit 300*c*1 includes a first conveying belt 310 that is fixed, a positioning stopper 317, and a guide plate 318. The first conveying belt 310 is stretched around a driving pulley 309*a* and a driven pulley 309*b*. A top surface of the first conveying belt 310 is flush with a top surface of the base 308 and also functions as a reference surface for conveyance of the booklet BT.

The upper unit 300*c*2 includes a second conveying belt 312, a driving pulley 311*a*, a driven pulley 311*b*, a support member 313, guide shafts 315, a pressing plate 316, and compression springs 314. The second conveying belt 312 is stretched around the driving pulley 311*a* and the driven pulley 311*b*. The support member 313 integrally supports the second conveying belt 312, the driving pulley 311*a*, and the driven pulley 311*b*. The guide shafts 315 are attached to a top surface of the support member 313. The pressing plate 316 is mounted to be able to vertically move. The compression springs 314 are attached to the guide shafts 315 between the support member 313 and the pressing plate 316. The compression springs 314 apply an elastic force to the support member 313 and the pressing plate 316 to separate them from each other. The second conveying belt 312, the driving pulley 311*a*, the driven pulley 311*b*, the support member 313, the guide shafts 315, and the pressing plate 316 are movable upward and downward integrally as the upper unit 300*c*2 and therefore can relatively change a gap between the top surface of the first conveying belt 310 and a bottom surface of the second conveying belt 312.

This configuration makes it possible to narrow the gap between the first and second conveying belts 310 and 312 when the booklet BT is to be held therebetween. At that time, a gap between the pressing plate 316 and the support member 313 is also changeable. Accordingly, when the pressing plate 316 is lowered after a top surface of the booklet BT has been pressed by the second conveying belt 312, the compression springs 314 are further compressed. Thus, a holding force or pressing force to the booklet BT can be increased. A driving mechanism (not shown) that moves the upper unit 300*c*2 upward and downward includes a motor a power transmission mechanism, and a vertical guide, using which the pressing plate 316 is directly moved upward and downward. When the pressing plate 316 is moved upward and downward while maintaining an initial gap between the pressing plate 316 and the support member 313, the entire upper unit 300*c*2 is moved upward and downward. When the pressing plate 316 is further lowered after the second conveying belt 312 contacts the top surface of the booklet BT, the compression springs 314 are compressed to an extent corresponding to this downward motion, causing the compression springs 314 to exert a pressing force. This pressing force serves as the holding force or the pressing force to the booklet BT.

The first conveying belt 310 and the second conveying belt 312 have a function of conveying the booklet BT and also function as guides during sheet alignment. The first and second conveying belts 310 and 312 also function as guides during skew correction. Accordingly, the first and second conveying belts 310 and 312 has a surface, at which contact with the booklet BT is made, are made of a material reducing a friction coefficient between each of surfaces of the first and second conveying belts 310 and 312 brought into contact with the booklet BT and the sheet. In addition, the conveying belts 310 and 312 are configured to exhibit the friction coefficients near to each other. This configuration lightens a force applied to the top of the booklet and a force applied to the bottom of the booklet during pressing, and makes the force on the top near to the force on the bottom, thereby reducing misalignment during pressing.

In the present embodiment, the first and second conveying belts 310 and 312 also have the guiding function to serve as a guide unit. Alternatively, a configuration may be employed in which the guide plate 318 is arranged along the lower first conveying belt 310 so that the guide plate 318 functions as a guide and another conveying unit such as a conveying roller is used to perform the function of conveying the booklet BT. In this configuration, a top surface of the guide plate 318 is flush with the top surface of the base 308 and functions as a reference surface for conveyance of the booklet BT. Another configuration in which the upper second conveying belt 312 is configured to press the booklet BT against the guide plate 318 may be employed.

In the present embodiment, the lower first conveying belt 310 is fixed, while the upper second conveying belt 312 ascends and descends. Alternatively, a configuration in which the upper second conveying belt 312 is fixed, while the lower first conveying belt 311 is movable, or a configuration in which both the first and second conveying belts 310 and 312 are movable may be employed.

The positioning stopper 317 provided in the aligning section 300*c* includes a moving mechanism (not shown) that is movable in the booklet conveying direction. The positioning stopper 317 is moved by the moving mechanism to a predetermined position based on the information about the size of the booklet BT, a cut amount, or the like and performs positioning by being abutted by the spine of the booklet BT. Meanwhile, the moving mechanism includes a motor and a power transmission mechanism for the motor.

FIGS. 9 to 14 are explanatory drawings illustrating cutting operations to be performed by the cutting apparatus according to the embodiment. FIG. 15 is a block diagram illustrating a control structure of the image forming system according to the embodiment.

Referring to FIG. 15, the first sheet postprocessing apparatus 1, the second sheet postprocessing apparatus (center-folding-and-saddle-stitching apparatus) 2, and the third sheet postprocessing apparatus (cutting apparatus) 3 are connected downstream of the image forming apparatus PR in the image forming system according to the present embodiment as illustrated in FIG. 1. The image forming apparatus PR includes a control circuit PR0. The sheet postprocessing apparatuses 1, 2, and 3 include a control circuit 150, the control circuit 250, and a control circuit 350, respectively. Each of the control circuits PR0, 150, 250, and 350 includes a microcomputer that includes a read-only memory (ROM), a random access memory (RAM), an I/O interface, and a corresponding one of a CPU PR1, a CPU 151, the CPU 251, and a CPU 351. The image forming apparatus PR and the sheet postprocessing apparatuses 1, 2, and 3 are connected in series in terms of control via communications ports PR2, 161, 162, 261, 262, and 361. The control circuits 150, 250, and 350 of the first to third sheet postprocessing apparatuses 1, 2, and 3 function as sub CPUs under control of the CPU PR1 of the image forming apparatus PR as a main CPU. The operation panel PN that functions as a man-machine interface is connected to the image forming apparatus PR so as to be able to receive an input from an operator and provide a notification to the operator via a display device.

Put another way, each of sections of the sheet postprocessing apparatuses 1, 2, and 3 is controlled by a corresponding one of the CPUs 151, 251, and 351 mounted on the corresponding apparatus; and system control is executed by the CPU PR1 of the image forming apparatus PR. As for control operations to be performed by the apparatuses, each of the CPUs 151, 251, and 351 reads program codes stored in the ROM of the corresponding apparatus, and executes control operation based on a program defined in the program codes while using the RAM of the apparatus as a working area and a data buffer. The CPU 151 of the first sheet postprocessing apparatus 1 can carry out mutual communications using the communications port 161 with the CPU PR1 of the image forming apparatus PR via the communications port PR2 of the image forming apparatus PR. Each of the CPUs 251 and 351 of the second and third sheet postprocessing apparatuses 2 and 3 can carry out mutual communications with the CPU PR1 of the image forming apparatus PR via the communications port(s) and the CPU(s) connected nearer the image forming apparatus PR than those of a corresponding one of the second and third sheet postprocessing apparatuses 2 and 3. In the image forming system configured as described above, information necessary for the CPU PR1 of the image forming apparatus PR to execute control is transmitted to the image forming apparatus PR from the CPUs 351, 251, and 151 of the third sheet postprocessing apparatus 3, the second sheet postprocessing apparatus 2, and the first sheet postprocessing apparatus 1; control signals output from the CPU PR1 of the image forming apparatus PR are transmitted to the CPUs 151, 251 and 351 of the first sheet postprocessing apparatus 1, the second sheet postprocessing apparatus 2, and the third sheet postprocessing apparatus 3.

In this way, the booklet information is transmitted from the CPU PR1 of the image forming apparatus PR to the CPU 351 of the cutting apparatus 3 which is the third postprocessing apparatus. The CPU 351 of the cutting apparatus 3 performs pressing operation and the cutting operations described above based on the received booklet information.

Operations to be performed by the cutting apparatus 3 and processing related to the operations are described below with reference to FIGS. 9 to 14 that are the explanatory diagrams of the operations.

Figure 9:
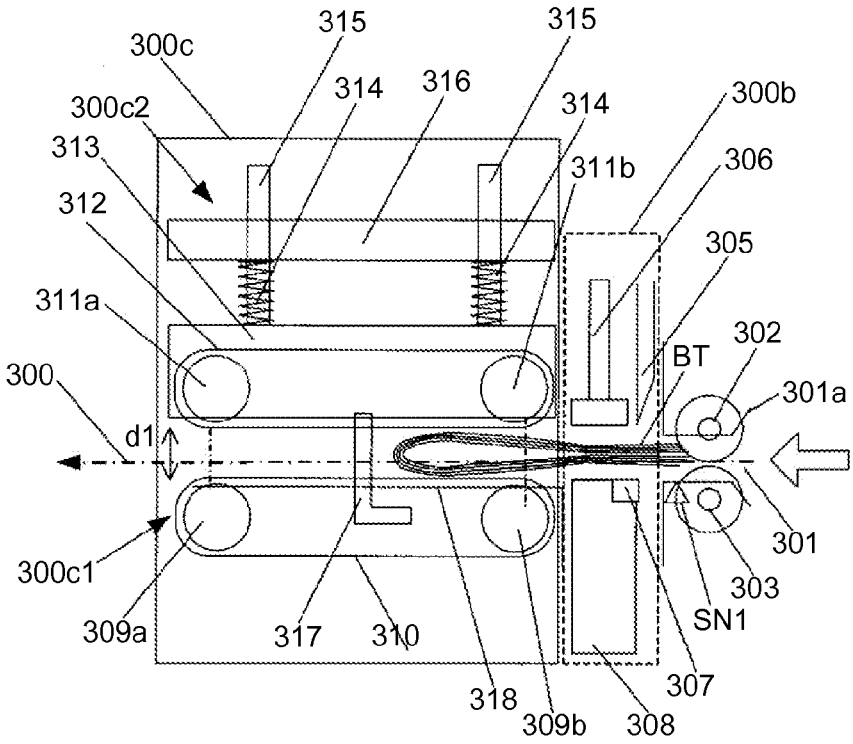
FIG. 9 is an explanatory diagram of cutting operations to be performed by the cutting apparatus, illustrating a state immediately after a booklet is conveyed into the cutting apparatus.

FIG. 9 is a diagram illustrating a state immediately after the booklet BT is conveyed into the cutting apparatus 3. In FIG. 9, the booklet BT is conveyed through between the entrance guide plates 301*a* into the cutting apparatus 3. At this time, each section of the cutting apparatus 3 starts booklet-receipt preparing operation when a booklet-leading-end detection signal output from an entrance sensor SN1 provided immediately downstream of the booklet receiving port 301 or a leading-end-of-folded-portion detection signal output from the crease passage sensor 293 of the saddle-stitch booklet-making apparatus 2 is detected. The booklet-receipt preparing operation is an operation of lowering the upper unit 300*c*2 from its initial position. The booklet-receipt preparing operation brings motion to a position where a gap between the bottom surface of the second conveying belt 312 and the top surface of the first conveying belt 310 is a first gap d1 to receive sheets conveyed into the cutting apparatus 3. The first gap d1 is determined by the CPU 351 based on the booklet information such as information about sheet thickness, sheet size, the number of sheets to be stapled, whether the sheet is made of special paper, or the like by consulting a database stored in a memory (not shown) in the control circuit 350 of the cutting apparatus 3. This will be described later. The gap d1 is such a gap that enables the first and second conveying belts 310 and 312 to generate enough friction to convey the booklet BT after the booklet BT has been conveyed into the cutting apparatus 3 by the pair of conveying rollers 302 and 303. In short, the gap d1 can have any size so long as the booklet BT can be conveyed.

The positioning stopper 317 moves to a position where sheet positioning is to be performed according to the information about the booklet size, the cut amount, and/or the like. When the positioning stopper 317 finishes moving to the position, the pair of conveying rollers 302 and 303 and the first and second conveying belts 310 and 312 start rotating to start receiving the booklet BT. The driving pulleys 309*a* and 311*a* of the first and second conveying belts 310 and 312 are connected to each other, in relation to driving, to make rotations of the first and second conveying belts 310 and 312 in phase. The first and second conveying belts 310 and 312 in this state stop rotating when a predetermined period of time has elapsed after the entrance sensor SN1 has detected the leading end of the spine (the folded portion) of the booklet BT conveyed into the cutting apparatus 3. The leading end (the crease or spine shearing) of the booklet BT is stopped at a position upstream from the positioning stopper 117 by a predetermined distance.

Figure 10:
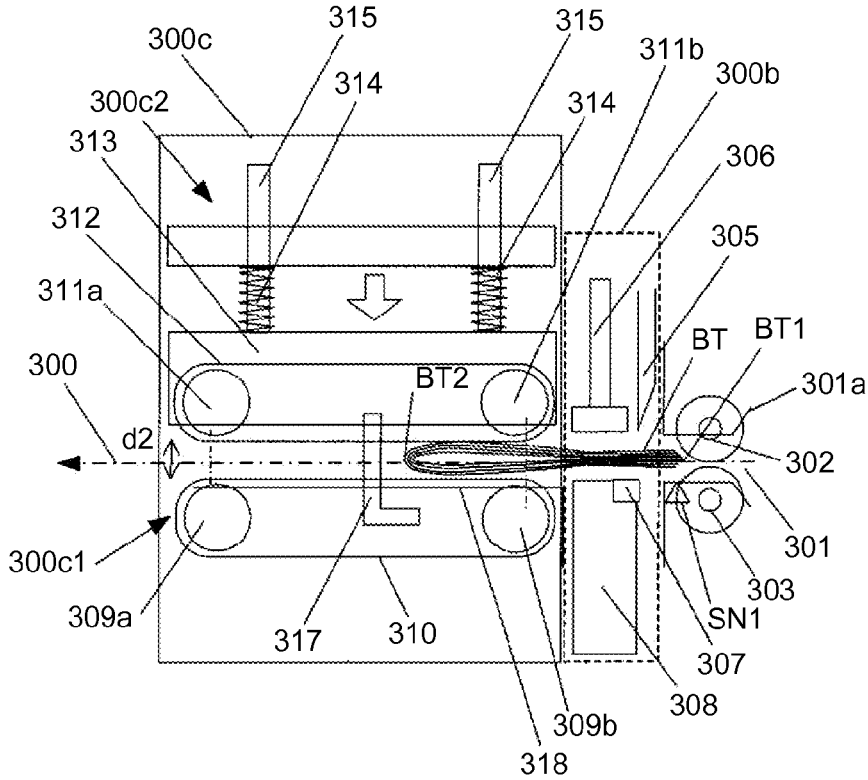
FIG. 10 is an explanatory diagram of the cutting operations to be performed by the cutting apparatus, illustrating an operation of pressing the booklet conveyed into the cutting apparatus and stopped until the thickness of the booklet becomes a predetermined thickness.

FIG. 10 is a diagram explaining an operation of pressing the stopped booklet until its thickness becomes a predetermined thickness. After the booklet BT has stopped in the state illustrated in FIG. 9, the upper unit 300*c*2 descends to a position where a gap between the top surface of the first conveying belt 310 and the bottom surface of the second conveying belt 312 is a second gap d2. The booklet BT that swells and is thick is pressed until a thickness of the booklet BT becomes the predetermined thickness in this way. The second gap d2 is determined as alignment gap according to the booklet information such as information about sheet thickness, sheet size, the number of sheets to be stapled, whether the sheet is made of special paper, or the like, like as the first gap d1. In this state, only the position of the support member 313 has been changed to an aligning position.

Figure 11:
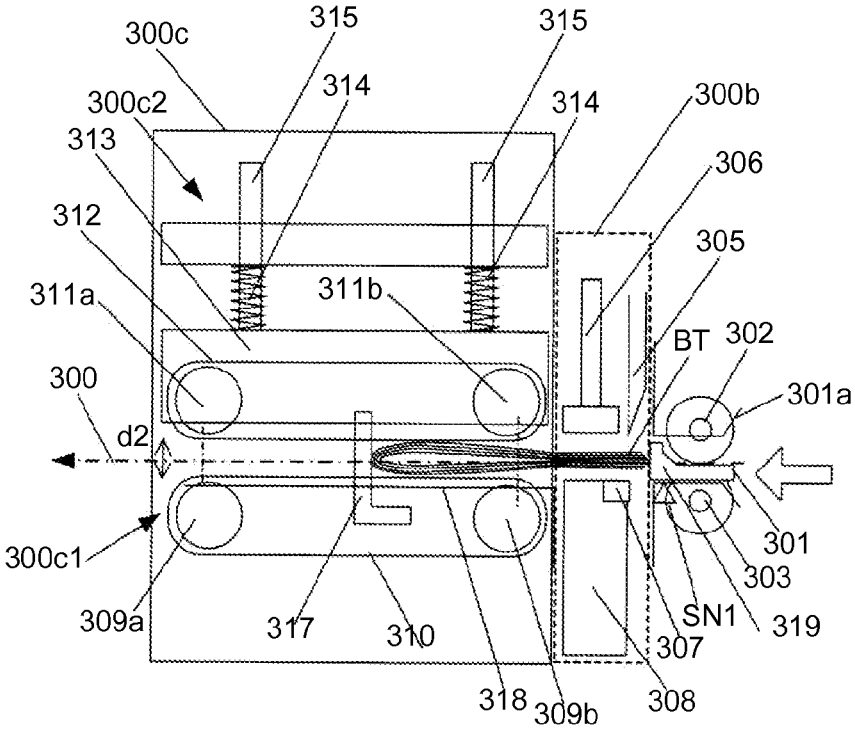
FIG. 11 is an explanatory diagram of the cutting operations to be performed by the cutting apparatus, illustrating an operation of aligning the booklet in a conveying direction.

FIG. 11 is a diagram explaining an operation of aligning the booklet in the conveying direction and performing skew correction. In a state where the booklet BT has been pushed into the second gap d2 as in the state illustrated in FIG. 10 and the second gap d2 is maintained, the trailing-end jogger 319 is driven. The trailing-end jogger 319 presses the fore edge (a trailing-end portion BT1) of the booklet BT toward the positioning stopper 317, causing the spine (a leading-end portion BT2 in the conveying direction) of the booklet BT to abut on the positioning stopper 317. The booklet BT is thus positioned in the conveying direction. The gap d2 is such a gap that causes the booklet BT to be pressed to enable the trailing-end jogger 319 to move the booklet BT toward the positioning stopper 317 without causing deformation or a warp of the booklet BT; in other words, that enables the aligning operation while restricting a height of sheets.

A method of moving the booklet BT by the first and second conveying belts 310 and 312 can alternatively be employed as a method of causing the booklet BT to abut on the positioning stopper 317. However, a surface sheet of the booklet BT can be undesirably partially curled in a case where the conveying power of the first and second conveying belts 310 and 312 is large. For such a case, it is necessary to set the conveying power of the first and second conveying belts 310 and 312 so as to prevent occurrence of the curling in the booklet BT. The present embodiment employs the trailing-end jogger 319 to avoid occurrence of such curling.

Figure 12:
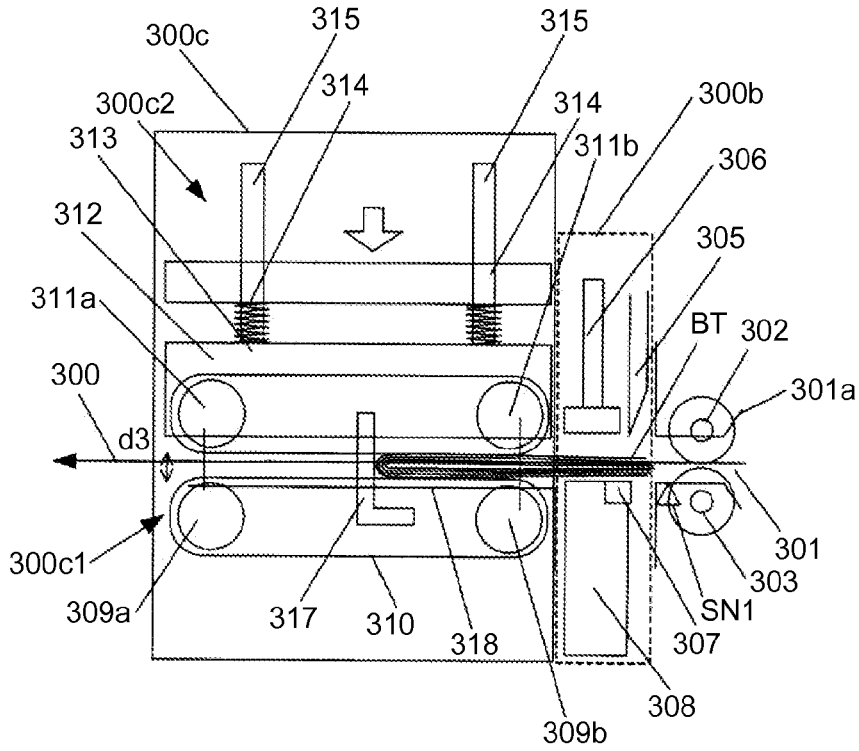
FIG. 12 is an explanatory diagram of the cutting operations to be performed by the cutting apparatus, illustrating an operation of pressing and fixing the booklet.

FIG. 12 is a diagram explaining an operation of pressing the booklet to fix it. When the booklet BT is positioned by the trailing-end jogger 319 against the positioning stopper 317, the upper unit 300*c*2 is further lowered to a position where a distance between the bottom surface of the second conveying belt 312 and the top surface of the first conveying belt 310 is a third gap d3. As a result, the booklet BT is pressed against the lower unit 300*c*1 so that the booklet BT is fixed between the first and second conveying belts 310 and 312.

At this time, the pressing plate 316 is further lowered after the second conveying belt 312 has abutted on the top surface of the booklet BT. As a result, the elastic force of the compression springs 314 is applied to the booklet BT as a pressing force in a state where the booklet BT is kept to have a minimum thickness. The pressing force applied to the booklet BT can be controlled by changing or setting a descent amount of the pressing plate 316. A descent amount of the upper unit 300*c*2 (i.e., the gap between the first and second conveying belts 310 and 312) and the descent amount of the pressing plate 316 are determined according to the booklet information such as information about sheet thickness, sheet size, the number of sheets to be stapled, and paper type (special paper or the like). The gap d3 is a gap that causes the booklet BT to be pressed such that a thickness of the booklet BT becomes the minimum thickness in a state where each sheet in the booklet BT is spread, thereby enabling finishing the booklet BT to have a final thickness; or, a gap that enables pressing the booklet BT to fix it.

Figure 13:
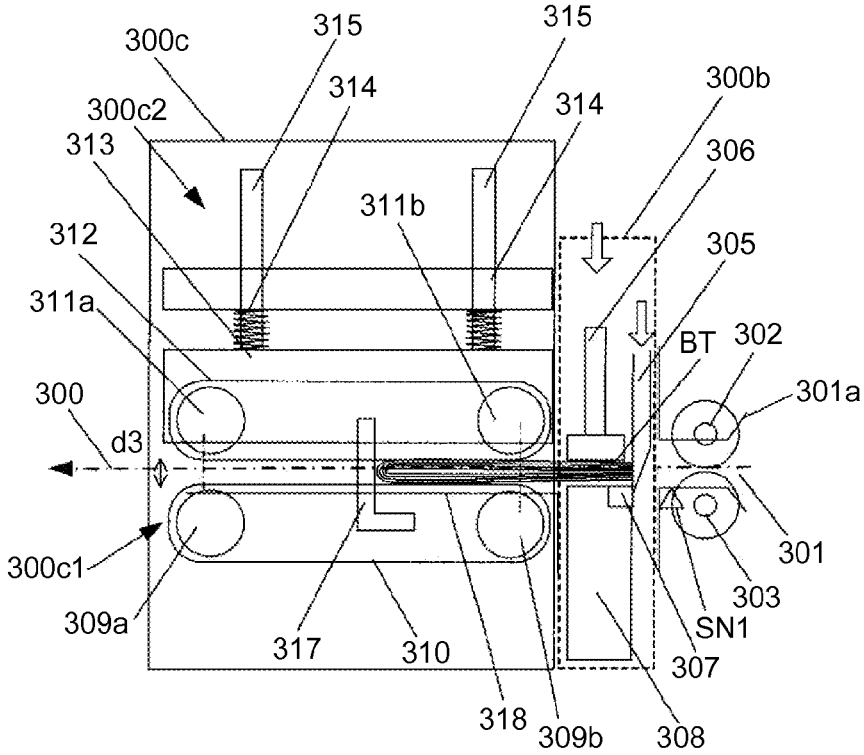
FIG. 13 is an explanatory diagram of the cutting operations to be performed by the cutting apparatus, illustrating an operation of cutting the booklet after skew correction.

FIG. 13 is a diagram explaining an operation of cutting a booklet after booklet alignment. After the booklet BT is positionally aligned, and pressed and fixed as illustrated in FIG. 12, the pressing member 306 arranged near the upper cutting blade 305 is lowered to press a portion, which is near a to-be-cut position, of the booklet BT against the top surface of the base 307. Then, the upper cutting blade 305 is lowered to cut the fore edge of the booklet BT between the upper cutting blade 305 and the lower cutting blade 307. Waste pieces from the fore edge of the cut booklet are put in the waste bin 320. The descent amount of the pressing plate 316 is such an amount that causes the compression springs 314 to apply a pressing force that holds and fixes each of sheets, particularly the surface sheet, of the booklet BT to prevent it from being misaligned when the pressing member 306 is lowered to press the fore-edge side of the booklet BT against the top surface of the base 308.

Figure 14:
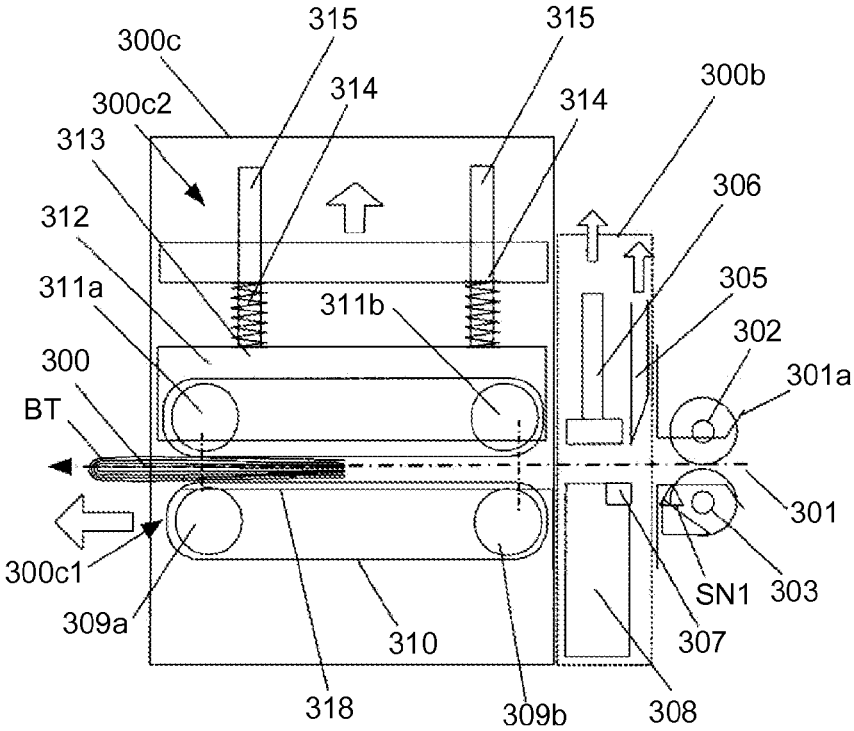
FIG. 14 is an explanatory diagram of the cutting operations to be performed by the cutting apparatus, illustrating an operation after completion of cutting.
Figure 15:
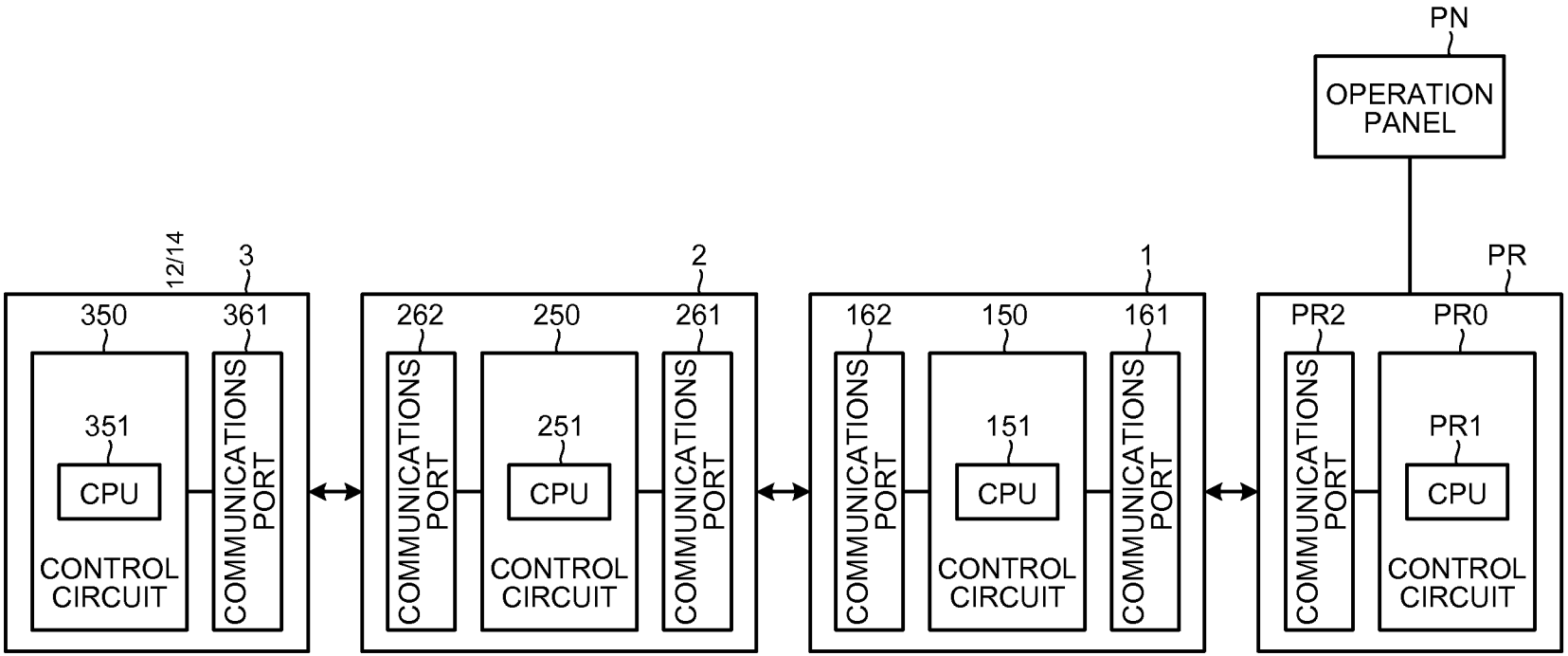
FIG. 15 is a block diagram illustrating a control structure of the image forming system according to the embodiment.

FIG. 14 is a diagram explaining an operation after cutting. After the cutting illustrated in FIG. 13, the upper cutting blade 305 and the pressing member 306 retreat upward to their initial positions. Subsequently, the pressing plate 316 and the upper unit 300*c*2 move upward to lessen the pressure applied to the booklet BT to a pressure level that enables the booklet to be conveyed. The upward moving distance at this time is determined according to the booklet information such as information about sheet thickness, sheet size, the number of sheets to be stapled, paper quality (special paper), or the like. Thereafter, the first and second conveying belts 310 and 312 are rotated in a conveying direction to discharge the booklet BT having its fore edge cut to the outside of the cutting apparatus 3, and a series of the operations performed in the cutting apparatus 300 completes.

The database to be consulted for the first to third gaps d1, d2, and d3 and the descent amount of the pressing plate 316 is made by storing optimum values of the first to third gaps d1, d2, and d3 and the descent amount of the pressing plate 316. The optimum values are determined in advance using a real apparatus before shipment for each combination of elements, such as sheet thickness, sheet size, the number of sheets to be stapled, and paper type (special paper or the like), of each of booklets BT that are possibly subjected to cutting by the cutting apparatus 3. When, for example, booklet information indicating that sheet thickness is regular (when the sheet thickness is classified into thin paper, regular paper, and thick paper; the sheet thickness is expressed in basis weight ($g/m^2$), for instance), sheet size is A3, the number of sheets to be stapled is ten, and paper type is ordinary paper is transmitted to the CPU 351 of the cutting apparatus 3 from the CPU PR1 of the image forming apparatus PR, the CPU 351 obtains the first to third gaps d1, d2, and d3 and the descent amount of the pressing plate 316 associated with that booklet information from the database in the memory to thereby determine the first to third gaps d1, d2, and d3 and the descent amount of the pressing plate 316. This enables cutting to be performed in a state where the booklet BT is held with an optimum holding force or pressing force.

Holding the booklet BT in this way reduces occurrence of deflection of the booklet BT and prevents misalignment when the booklet BT is pressed by the pressing member, thereby enabling highly accurate sheet processing.

Figure 16:
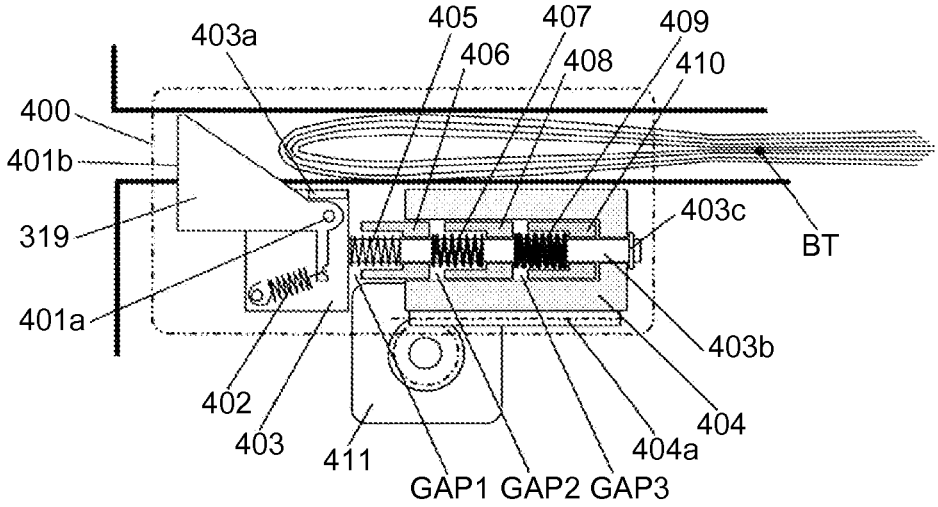
FIG. 16 is a diagram illustrating in detail the configuration of a skew correction device including a trailing-end jogger according to the embodiment.

FIG. 16 is a diagram illustrating in detail the configuration of a skew correction device including the trailing-end jogger according to the embodiment. FIGS. 17 to 20 are diagrams illustrating operations to be performed by the skew correction device.

In FIGS. 16 to 20, a skew correction device 400 includes the trailing-end jogger 319, a moving mechanism that causes the trailing-end jogger 319 to reciprocate parallel to the booklet conveying direction, and an elastic-force applying mechanism that applies an elastic force to the trailing-end jogger 319.

The trailing-end jogger 319 includes a pivot support 401*a* that supports the trailing-end jogger 319 in a manner that the trailing-end jogger 319 can pivot in a predetermined range and an abutting surface 401*b* that abuts on and presses the fore edge of the booklet. The trailing-end jogger 319 is supported by a jogger rod 403 via the pivot support 401*a*. A return spring 402 is stretched between a lug on the jogger rod 403 and a lug on a rear end portion of the trailing-end jogger 319. The return spring 402 always applies an elastic force to the trailing-end jogger 319 so that the abutting surface 401*b* tends to be kept in an orientation in which the abutting surface 401*b* is perpendicular to the booklet conveying direction, in a state where trailing-end jogger 319 is supported by the pivot support 401*a*. FIG. 16 illustrates a position of the trailing-end jogger 319 in a state where the elastic force of the return spring 402 has brought a back surface of the trailing-end jogger 319 into contact with a stopper 403*a* provided on the guide rod 403. This position is the initial position of the trailing-end jogger 319.

The moving mechanism includes a jogger casing 404, a rack 404*a* arranged on a bottom of the jogger casing 404, and a driving motor 411 that includes a driving shaft, to which a pinion 411*a* that meshes with the rack 404*a* is attached, and supplies driving power to the rack 404*a*. The jogger casing 404 can reciprocate in the conveying direction and supports a guide shaft 403*b* of the guide rod 403. According to this configuration of the moving mechanism, a guide casing 304 moves two opposite directions parallel to a booklet conveying direction D1 depending on a direction in which the motor 411 rotates. Reference symbol 403*c* denotes a stopper that limits a moving position of the guide shaft 403*b*. The stopper 403*c* limits a maximum advanced position of the guide rod 403 relative to the jogger casing 404 in the booklet conveying direction (direction indicated by arrow D1).

The elastic-force applying mechanism includes a three-stage elastic-force applying section that holds the guide shaft 403*b* projecting in a rear end portion of the guide rod 403 to elastically push the guide rod 403 in the booklet conveying direction. The elastic-force applying mechanism includes a first guide 406, a second guide 408, and a third guide 410 arranged in this order from downstream to upstream in the booklet conveying direction (direction indicated by arrow D1). A spring mount is formed in each of the first to third guides 406 to 410. A first spring 405, a second spring 407, and a third spring 409 are attached to the spring mounts of the first guide 406, that of the second guide 408, and that of the third guide 410, respectively. The first spring 405, the second spring 407, and the third spring 409 are configured to elastically push the guide rod 403, the first guide 406, and the second guide 408 in a downstream direction in the booklet conveying direction, respectively. Preset gaps GAP1, GAP2, and GAP3 are provided between the guide rod 403 and the first guide 406, between the first guide 406 and the second guide 408, and between the second guide 408 and the third guide 410, respectively.

Although the first to third springs 405, 407, and 409 and the first to third guides 406, 408, and 410 are provided in the present embodiment, first to nth (n is an integer equal to or greater than two) springs and first to nth (n is an integer equal to or greater than two) may be provided. A minimum number of the stages is two (n=2). Although three stages (n=3) are provided in the present embodiment, four or more stages (n≥4) may be provided depending on the magnitude of the pressing force required to be applied to the trailing-end jogger 319, the number of sheets in the booklet ST, sheet thickness, and/or the like.

Figure 17:
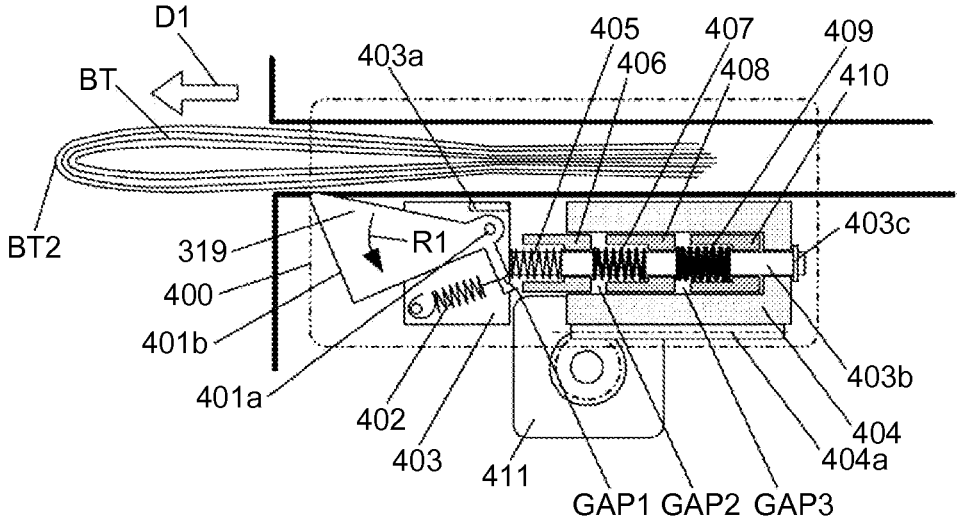
FIG. 17 is an explanatory diagram of operations to be performed by the skew correction device, illustrating a state where a booklet is conveyed into the device while pushing the trailing-end jogger to move it out from a way of the booklet.

In the skew correction device configured in this way, when the booklet BT is conveyed into the skew correction device from the upstream saddle-stitch booklet-making apparatus 2, the leading-end portion BT2 of the booklet BT abuts on the back surface of the trailing-end jogger 319, causing the trailing-end jogger 319 to pivot about the pivot support 401*a* in a direction indicated by arrow R1 against the elastic force exerted by the return spring 402 as illustrated in FIG. 17.

Figure 18:
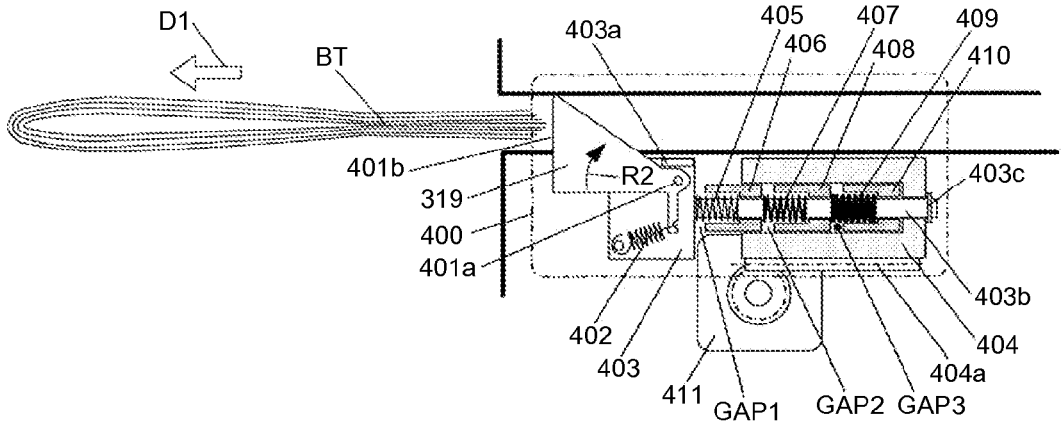
FIG. 18 is an explanatory diagram of the operations to be performed by the skew correction device, illustrating a state immediately before skew correction where the booklet has been moved past the trailing-end jogger.

When the booklet BT finishes passing by the trailing-end jogger 319 as illustrated in FIG. 18, the trailing-end jogger 319 is returned in a direction indicated by arrow R2 by the return spring 402. At this time, the back surface of the trailing-end jogger 319 abuts on the stopper 403*a* of the guide rod 403 so that the back surface of the trailing-end jogger 31 is fixed at this position.

Figure 19:
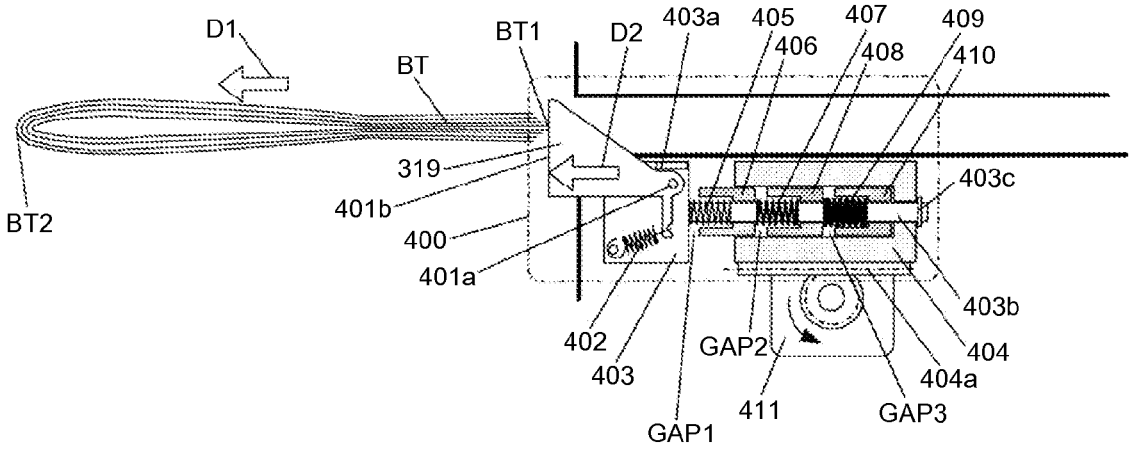
FIG. 19 is an explanatory diagram of the operations to be performed by the skew correction device, illustrating a state where skew correction is performed on the booklet using the trailing-end jogger.

Subsequently, the driving motor 411 is rotated in a direction indicated by arrow R3, thereby moving the trailing-end jogger 319 in the direction indicated by arrow D2 as illustrated in FIG. 19. As a result, the abutting surface 401*b* of the trailing-end jogger 319 abuts on the fore edge (the trailing-end portion BT1) on the trailing end of the booklet BT and moves the booklet BT by pushing it from the fore-edge side.

Figure 20:
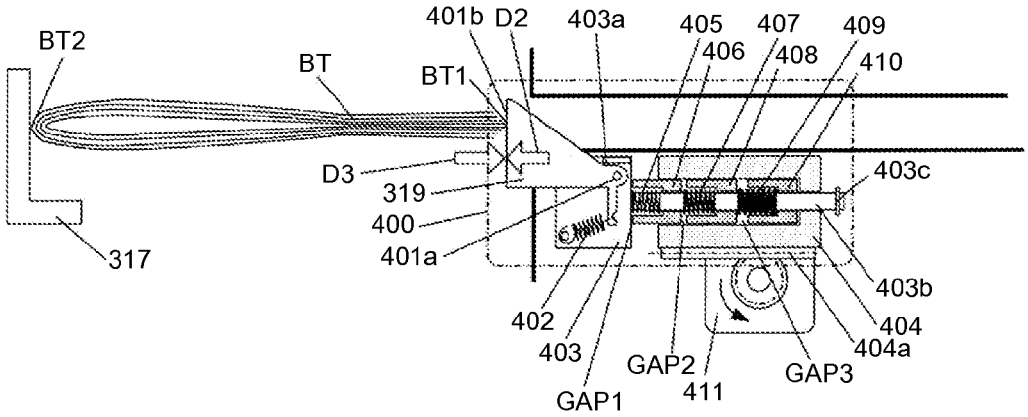
FIG. 20 is an explanatory diagram of the operations to be performed by a skew correction device, illustrating a state where skew correction on the booklet using the trailing-end jogger is completed.

When the booklet BT is pushed from the fore-edge side as illustrated in FIG. 19, the leading-end portion (which corresponds to the spine at a time of making booklet) BT2 of the booklet BT in the booklet conveying direction abuts on the positioning stopper 317 as illustrated in FIG. 20. At this point in time, the booklet BT is stopped. Thereafter, the CPU 351 drives the driving motor 411 to move the jogger casing 404 to thereby further move the trailing-end jogger 319 mounted on the guide rod 403 so that a pressing force of an appropriate magnitude is applied to the booklet BT.

The pressing force applied to the booklet BT depends on elastic forces of the first spring 405, the second spring 407, and the third spring 409, and positions of the first guide 406, the second guide 408, and the third guide 410. When the elastic force of the first spring 405 is approximately 0.1 to 1 N, that of the second spring 407 is approximately 1 to 3 N, that of the third spring 409 is approximately 3 to 10 N, and the number of sheets in the booklet BT is small, the driving motor 411 is rotated by an amount that causes only the first spring 305 to be elastically deformed to feed the jogger casing 404 in the conveying direction (direction indicated by arrow D1). In this case, the booklet BT is aligned with a pressing force of approximately 0.1 to 1 N.

When the number of sheets in the booklet BT is medium, a pressing force of a desired magnitude can be attained by causing the first spring 405 to finish elastic deformation to eliminate the gap GAP1 between the guide rod 403 and the first guide 406 and, furthermore, causing the second spring 407 to be elastically deformed. When the number of sheets in the booklet BT is large, a pressing force of a desired magnitude can be attained by eliminating the gap GAP1 between the guide rod 403 and the first guide 406 and the gap GAP2 between the first guide 406 and the second guide 408, and causing the third spring 409 to be elastically deformed.

FIG. 20 depicts an example where the number of sheets in the booklet BT is medium and illustrates a state where the gap GAP1 is eliminated and the booklet BT is pushed by the elastic force exerted by the second spring 407. When skew correction is completed in this state, the trailing-end jogger 319 retreats to a position where the elastic force of only the first spring 405 is applied to the trailing-end jogger 319. Put another way, the trailing-end jogger 319 retreats from a position illustrated in FIG. 20 where the gap GAP1 is eliminated to the position where the gap GAP1 is generated (in a direction indicated by arrow D). This enables an operation of pressing and fixing the booklet BT illustrated in FIGS. 11 and 12 to be performed while preventing occurrence of spring-back from the pushed position illustrated in FIG. 20 when the trailing-end jogger 319 retreats.

Which one of the first to third springs 405, 407, and 409 is to be caused to act determined depending on the booklet information such as information about sheet thickness, sheet size, the number of sheets to be stapled, whether the sheet is made of special paper, or the like varies depending on apparatus specification. The example described above is only exemplary. The elastic forces of the first to third springs 405, 407, and 409 are also not limited to the values described above, and are changed according to the specification.

Also in this case, the CPU 351 determines which one of the first to third springs 405, 407, and 409 is to be caused to act by consulting a database that contains information about optimum spring elastic forces and which one of the springs is to be caused to act that are determined in advance using a real apparatus before shipment for each combination of the elements, such as thickness, sheet size, the number of sheets to be stapled, and paper type (special paper or the like), of each of the booklets BT that are possibly subjected to cutting by the cutting apparatus 3.

As described above, the present embodiment yields the following effects.

1) Skew correction is performed by, as illustrated in FIG. 11, causing the trailing-end jogger 319 to jog the fore edge of the booklet BT in a state where the gap d2 between the belts, which is set so as to restrict the thickness of the booklet BT by pressing the booklet BT to a certain extent, is maintained to stabilize the length of the booklet BT, and thereby causing the leading-end portion of the booklet BT in the conveying direction (the spine of the booklet) to abut on the positioning stopper 317 so that positioning and skew correction are performed. Moving the booklet BT generates frictional resistance because the booklet BT receives a reaction force, which depends on the gap d2 between the first and second conveying belts 310 and 312, from the belts 310 and 312 that are stopped. Accordingly, it is necessary to jog the fore edge with a force greater than this resistance. As a matter of course, the smaller the coefficients of friction of the belts, the smaller the frictional resistance, and thus it is advantageous that the coefficients of friction of the belts are small. However, excessively large pressing forces are not desirable. An excessively large pressing force causes the booklet BT to be further pushed even after the booklet BT has abutted on the positioning stopper 317. This can cause a damage on the leading-end portion BT2 of the booklet BT, a damage such as an undesired folding resulting from buckling on the fore-edge side of the booklet, a damage on a fore-edge contacting portion, or the like.

In the present embodiment, a pushing force is changed based on a pushing amount of the trailing-end jogger 319 to the booklet BT, when the trailing-end jogger 319 pushes the trailing-end portion, in the conveying direction, of the booklet BT toward the positioning stopper 317 to thereby cause the leading-end portion BT2 of the booklet BT to abut on the positioning stopper 317. This makes it possible to perform positioning and skew correction with an optimum pushing force depending on the number of sheets in the booklet, sheet thickness, sheet quality, or the like.

2) It is necessary to adjust the pressing force in a range from approximately 0.1 to 10 N to perform skew correction on a booklet made of 1 to 50 sheets. Put another way, skew correction can be performed accurately without a damage to a booklet by changing the spring force to be applied between multiple levels of pressing force depending on booklet information (the number of sheets in a booklet, sheet thickness, sheet size, and/or sheet quality) on a per-booklet basis. Hence, the skew correction device according to the present embodiment includes the springs (the first to third springs 405, 407, and 409) to apply elastic force in multiple stages to adjust the pushing force to be exerted by the trailing-end jogger 319. To change the pushing force, the first to third springs 405, 407, and 409 are caused to apply the elastic force in the following sequence: the first spring 405 is caused to applies its elastic force first; then the second spring 407 is caused to apply its elastic force; thereafter the third spring 409 is caused to apply its elastic force. This enables adjustment of the pushing force to be performed easily. In other words, the present embodiment employs a configuration that includes pressing springs in two or more stages and can change the spring force in a stepwise manner according to a booklet pushing amount of the trailing-end jogger 319. This makes it possible to adjust the pressing force to be applied to the booklet BT by the trailing-end jogger 319 by changing the pushing amount of the booklet BT according to the booklet information.

3) The elastic forces exerted by the multistage springs are set in a manner such that the elastic force the closer to the trailing-end jogger the spring is, the weaker the elastic force of the spring is, and, for example, the elastic force of the first spring 405 is the weakest, that of the second spring 407 is second weakest, and that of the third spring 409 is third weakest. With this configuration, the smaller the pushing amount, the weaker the elastic force applied to the booklet BT; accordingly, application of an excessively large force to the booklet BT is prevented. As a result, occurrence of the damage described above can be prevented.

4) The guide members and the springs are configured in a manner such that abutting can occur between rigid bodies or, more specifically, between the first to third guide members 406, 408, and 410 and between the first guide member 406 and the trailing-end jogger 319. Accordingly, a pressing force to be applied to the booklet BT can be changed with a simple structure.

5) The pushing amount is set based on the booklet information that contains information about at least one of sheet thickness, sheet size, the number of sheets to be stapled, and whether the sheet is made of special paper. Accordingly, skew correction can be performed with an optimum pressing force.

6) The skew correction device according to the present embodiment is applied to the cutting apparatus 3 which is the third sheet postprocessing apparatus from among the image forming apparatus PR and the first to third sheet postprocessing apparatuses 1, 2, and 3. Accordingly, positioning and skew correction can be performed without causing misalignment of a booklet and skew, and hence accuracy in postprocessing such as fore-edge cutting can be increased.

The sheet bundle in the appended claims corresponds to an element denoted by reference symbol SB in the embodiment. The booklet corresponds to an element denoted by reference symbol ST. The conveying path corresponds to an element by reference numeral 300. The positioning unit corresponds to the positioning stopper 317. The pushing force changing unit corresponds to the first to third springs 405, 407, and 409, the first to third guides 406, 408, and 410, the driving motor 411, and the CPU 351. The abutting unit corresponds to the positioning stopper 317 and the trailing-end jogger 319. The elastic-force applying unit corresponds to the first to third springs 405, 407, and 409, the guide shaft 303*b*, and the first to third guide members 406, 408, and 410. The first to nth (n is an integer equal to or greater than two) springs correspond to the first to third springs 405, 407, and 409. The first to nth (n is an integer equal to or greater than two) guide members correspond to the first to third guide members 406, 408, and 410. The information about the booklet pushing amount corresponds to the booklet information (information about sheet thickness, sheet size, number of sheets to be stapled, whether the sheet is made of special paper, or the like). The image forming system corresponds to the image forming apparatus PR, and the first to third sheet postprocessing apparatuses 1, 2, and 3. The third sheet processing apparatus corresponds to the cutting apparatus.

According to an aspect of the present invention, it is possible to correct skew reliably without causing misalignment or a damage such as crease, bent, and/or scratch to a booklet conveyed to a skew correction device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A skew correction device comprising:

a conveying path through which a booklet formed by folding a sheet bundle is conveyed in a conveying direction;

a positioning unit on which a leading-end portion of the booklet in the conveying direction is to abut, the positioning unit being arranged to be able to protrude into and retreat from the conveying path;

an abutting unit that pushes a trailing-end portion of the booklet in the conveying direction, thereby moving the booklet toward the positioning unit and causing the leading-end portion of the booklet to abut on the positioning unit; and a pushing force changing unit that changes a pushing force applied by the abutting unit to the booklet to push the booklet against the positioning unit based on a pushing amount of the abutting unit to the booklet.

2. The skew correction device according to claim 1, wherein the abutting unit includes:

a trailing-end jogger that abuts on the trailing-end portion of the booklet and pushes the booklet; and an elastic-force applying unit that applies elastic force to the trailing-end jogger in multiple stages, and the pushing force changing unit changes the pushing force by causing multiple stages of the elastic-force applying unit to apply elastic-force sequentially in an order from the stage near the trailing-end jogger to the stage far from the trailing-end jogger.

3. The skew correction device according to claim 1, wherein the abutting unit includes:

a trailing-end jogger that abuts on the trailing-end portion of the booklet and pushes the booklet; and a spring unit that applies elastic force to the trailing-end jogger in multiple stages, and the pushing force changing unit changes the pushing force by causing the spring unit to apply multiple levels of elastic force in a stepwise manner according to the pushing amount of the abutting unit to the booklet.

4. The skew correction device according to claim 2, wherein the elastic-force applying unit includes:

a guide shaft arranged upstream of the trailing-end jogger in the booklet conveying direction;

a plurality of guide members slidably attached to the guide shaft; and a plurality of elastic members that are each provided on one of the plurality of guide members and elastically push the trailing-end jogger downstream in the booklet conveying direction, and the elastic forces of the plurality of elastic members are set in a manner such that the closer to the trailing-end jogger the elastic member is, the weaker the elastic force of the elastic member is.

5. The skew correction device according to claim 4, wherein as the pushing force increases, the elastic members are compressed sequentially in a manner such that the closer to the trailing-end jogger the guide member on which the elastic member is provided is, the earlier the elastic member is compressed to cause the guide member to abut on a member downstream in a moving direction of the trailing-end jogger, and, next to the elastic force of the elastic member arranged on the abutted guide member, the elastic force of the elastic member arranged on the guide member next closer than the abutted guide member is applied to the trailing-end jogger.

6. The skew correction device according to claim 4, wherein the elastic members include first to nth (n is an integer equal to or greater than two) springs, the guide members include at least first to nth (n is the integer equal to or greater than two) guide members, the first spring is attached to the first guide member to elastically push the trailing-end jogger, the nth spring is attached to the nth guide member to elastically push the (n−1)th guide member, and the trailing-end jogger pushes in the booklet in a manner such that elastic forces of the first to nth springs are sequentially applied as the pushing force applied to push the trailing-end jogger increases.

7. The skew correction device according to claim 4, wherein the trailing-end jogger retreats to a position where the trailing-end jogger receives the elastic force only from the elastic member closest to the trailing-end jogger when the trailing-end jogger completes skew correction that is performed by pushing the booklet.

8. The skew correction device according to claim 1, wherein the pushing amount is set based on booklet information that contains information about at least one of sheet thickness, sheet size, number of sheets to be stapled, and whether the sheet bundle is made of special paper.

9. An image forming system comprising a skew correction device, wherein the skew correction device includes:

a conveying path through which a booklet formed by folding a sheet bundle is conveyed in a conveying direction;

a positioning unit on which a leading-end portion of the booklet in the conveying direction is to abut, the positioning unit being arranged to be able to protrude into and retreat from the conveying path;

an abutting unit that pushes a trailing-end portion of the booklet in the conveying direction, thereby moving the booklet toward the positioning unit and causing the leading-end portion of the booklet to abut on the positioning unit; and a pushing force changing unit that changes a pushing force applied by the abutting unit to the booklet to push the booklet against the positioning unit based on a pushing amount of the abutting unit to the booklet.

10. A skew correction method comprising:

conveying a booklet formed by folding a sheet bundle along a conveying path;

causing a leading-end portion of the booklet in the conveying direction to abut on a positioning unit arranged to be able to protrude into and retreat from the conveying path;

performing skew correction on the booklet by pushing a trailing-end portion of the booklet in the conveying direction, which has abutted on the positioning unit, against the positioning unit; and changing a pushing force, with which the booklet is to be pushed by the abutting unit, based on a pushing amount of the abutting unit to the booklet by setting the pushing amount based on information relating to the pushing amount.

* * * * *